US006361155B1

(12) United States Patent
Kanda et al.

(10) Patent No.: US 6,361,155 B1
(45) Date of Patent: Mar. 26, 2002

(54) INK JET RECORDING HEAD AND METHOD FOR MANUFACTURING THE SAME

(75) Inventors: Torahiko Kanda; Kenichi Ohno; Yasuhiro Otsuka, all of Tokyo (JP)

(73) Assignee: NEC Corporation (JP)

( * ) Notice: Subject to any disclaimer, the term of this patent is extended or adjusted under 35 U.S.C. 154(b) by 0 days.

(21) Appl. No.: 09/602,117

(22) Filed: Jun. 23, 2000

(30) Foreign Application Priority Data

Jun. 23, 1999 (JP) ..... 11-177484
Dec. 3, 1999 (JP) ..... 11-345399

(51) Int. Cl.[7] ..... B41J 2/045; B41J 2/05
(52) U.S. Cl. ..... 347/70; 347/65; 347/67
(58) Field of Search ..... 347/70, 65, 67, 347/71

(56) References Cited

U.S. PATENT DOCUMENTS 5,485,184 A * 1/1996 Nakagomi et al. ..... 347/63

FOREIGN PATENT DOCUMENTS

JP 57-91274 6/1982
JP 5-330067 12/1993
JP 8-58089 3/1996

* cited by examiner

*Primary Examiner*—Thinh Nguyen
(74) *Attorney, Agent, or Firm*—Ostrolenk, Faber, Gerb & Soffen, LLP

(57) ABSTRACT

Any air trapped in a connection portion between adjacent ones of flow passage plates of an ink jet recording head in manufacturing the head. The head comprises: a reservoir plate with a reservoir cavity for forming an ink reservoir; a chamber plate with a chamber cavity for forming a pressure generating chamber in which ink is pressurized; and, a first air passage and a second air passage, wherein the first and the second air passage have first groove portions and second groove portions thereof staggered in cross section, respectively, and formed them in opposite surfaces of the reservoir plate and those of the chamber plate, respectively, and disposed them in a peripheral portion of the ink reservoir and that of the pressure generating chamber, respectively, wherein: the reservoir and the chamber form essential parts of an ink flow passage; the groove portions are staggered in arrangement not to have their front ones aligned with their rear ones in cross section, wherein the front ones being communicated with the rear ones through through-holes, respectively; whereby the air trapped in the connection portion may flow in a zigzag course along these groove portions to escape to the atmosphere.

26 Claims, 16 Drawing Sheets

FIG.3A
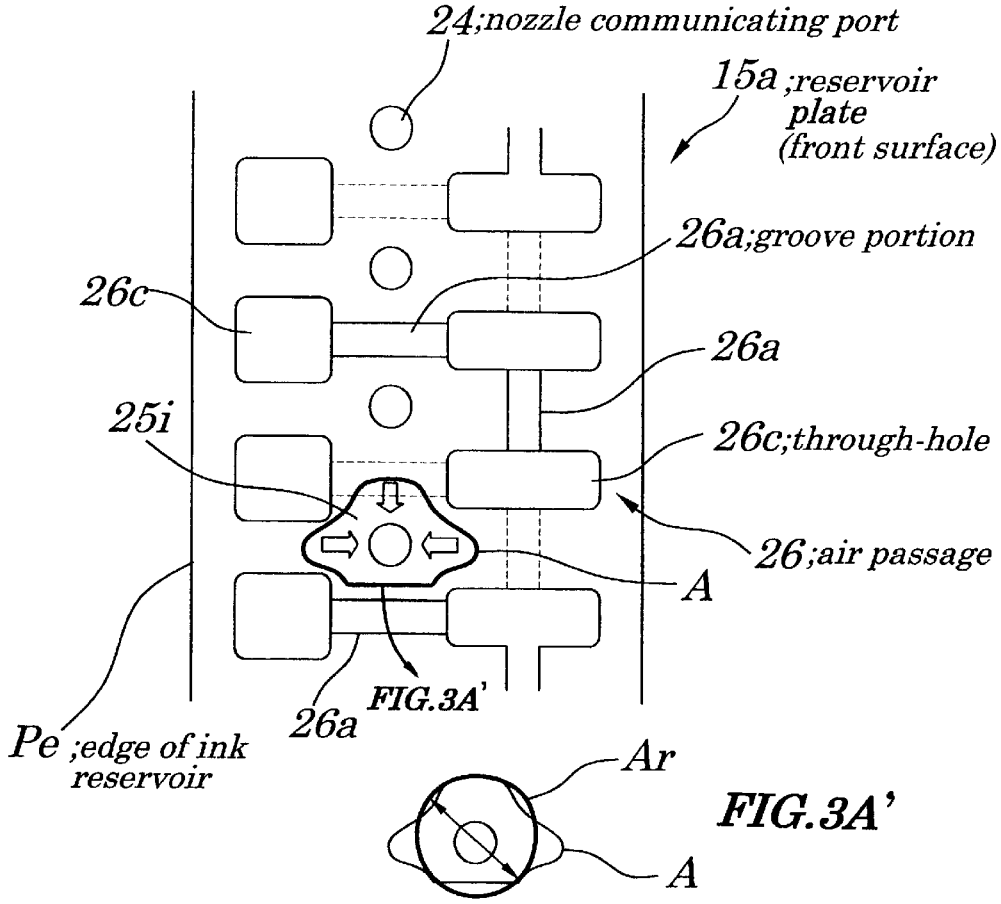
FIG.3A'
FIG.3B
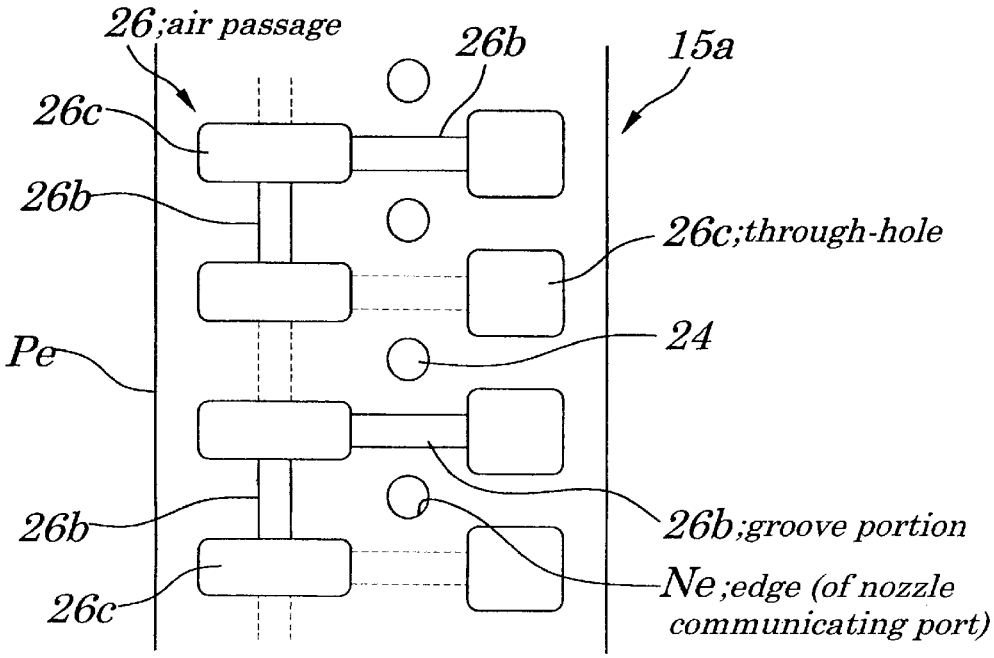

(front surface of substrate 30)

(rear surface of substrate 30)

FIG.6
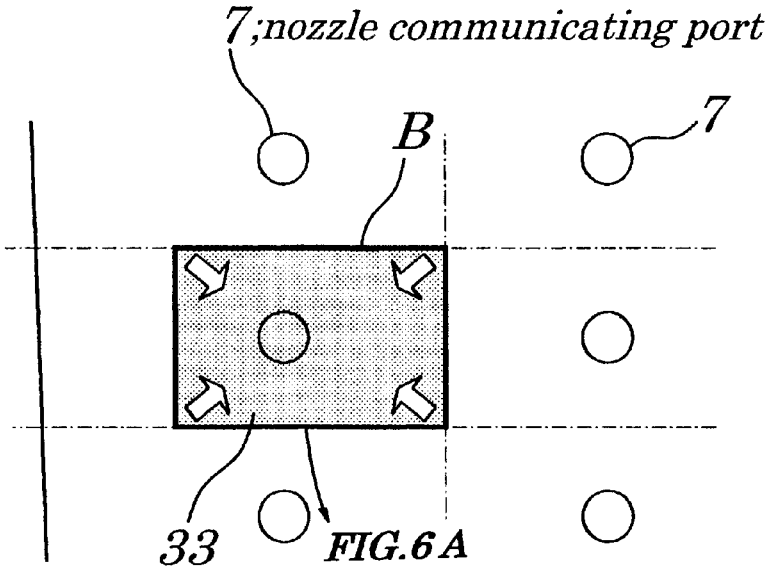
FIG.6A
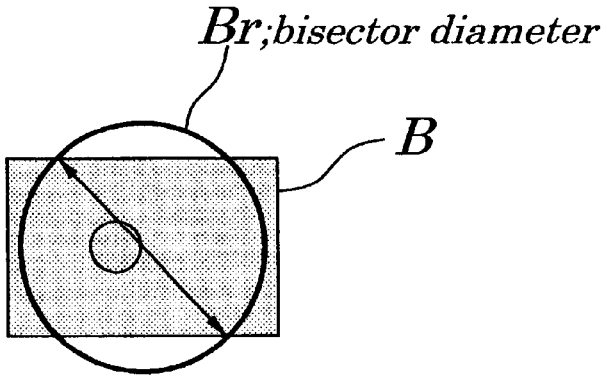
FIG.6A

FIG.9B (kear surface of reservoir plate)

(front surfaces of substrate 30)

(rear surfaces of substrate 30)

INK JET RECORDING HEAD AND METHOD FOR MANUFACTURING THE SAME

BACKGROUND OF THE INVENTION

1. Field of the Invention

The present invention relates to an ink jet recording head of an ink jet recording apparatus and a method for manufacturing the ink jet recording head of the ink jet recording apparatus, and more particularly to an on-demand type ink jet recording head of the ink jet recording apparatus and a method for manufacturing the on-demand type ink jet recording head, wherein the ink jet recording head ejects a series of ink droplets from its nozzles onto a recording medium in response to printing data inputted to the ink jet recording apparatus, so that the thus ejected ink droplets form desired characters, patterns or images on the recording medium.

2. Description of the Art

Heretofore, an ink jet recording head of a Kyser system has been known as one of conventional ink jet recording heads.

The Kyser system ink jet recording head (hereinafter referred to simply as a conventional ink jet recording head) is shown in FIG. 15. As is clear from FIG. 15, the conventional ink jet recording heed is substantially constructed of: ink reservoir 1; a plurality of pressure generating chambers 2 which are arranged side-by-side in a direction perpendicular to the paper, wherein each of the chambers 2 assumes an elongated shape; a plurality of ink supply ports 3 for supplying ink from the ink reservoir 1 to the pressure generating chambers 2; a plurality of vibrating plate portions 4, wherein each of the vibrating plate portions 4 defines or forms a bottom plate portion of each of the pressure generating chambers 2, and serves to change each of the pressure generating chambers 2 in volume in response to printing data inputted to a conventional ink jet recording apparatus provided with the conventional ink jet recording head; a plurality of piezoelectric actuators 5, wherein each of the piezoelectric actuators 5 is disposed adjacent to each of the vibrating plate portions 4 and serves to vibrate each of the vibrating plate portions 4; a plurality of ink erection nozzles 6, wherein each of the ink ejection nozzles 6 communicates with each of the pressure generating chambers 2 to eject ink from the pressure generating chambers 2 therefrom in response to the printing data; and, a plurality of nozzle communicating ports 7, wherein each of the nozzle communicating ports 7 provides fluid communication between each of the pressure generating chambers 2 and each of the ink ejection nozzles 6.

Ink is supplied from an ink cartridge (not shown) to each of the ink ejection nozzles 6 of the conventional ink jet recording head through fluid passages. These fluid passages are constructed of the ink reservoir 1, the ink supply ports 3, the pressure generating chambers 2, the nozzle communicating ports 7, and the nozzles 6 in this order. On the other hand, the piezoelectric actuators 5 are combined with the vibrating plate portions 4 to form a vibration system for generating pressure waves in the above-mentioned fluid passages.

In the conventional ink jet recording head having the above construction, in printing operations, the piezoelectric actuators 5 are energized to rapidly displace the vibrating plate portions 4, and thereby rapidly changing the pressure generating chambers 2 in volume, whereby pressure waves are generated in the above fluid passages. When the pressure waves are in their pressure-increasing phase, a small amount of ink is pushed out of the pressure generating chambers 2 through the ink ejection nozzles 6 to become ink droplets 8 ejected onto the recording medium (not shown) such as a sheet of paper or the like, and thereby forming desired dots on the recording medium. Formation of such dots on the recording medium is repeated in response to the printing data to form the desired characters, patterns or images on the recording medium.

The conventional ink jet recording head having the above construction is disclosed in Japanese Patent Application Laid-Open No. Hei8-58089, wherein the conventional ink jet recording head is constructed of a plurality of its component plates varying in cavity patterns. As shown in FIG. 16, component plates of the conventional ink jet recording head include a nozzle plate 6*a*, a reservoir plate 1*a*, a supply port plate 3*a*, a pressure generating chamber plate 2*a*, a vibrating plate 4*a*, and piezoelectric actuators 5 which are stacked vertically in this order and bonded to each other using an adhesive to form the conventional ink jet recording head.

The nozzle plate 6*a* is provided with a plurality of ink ejection nozzles 6 which are arranged in a row or staggered along an appropriate straight line. On the other hand, the reservoir plate 1*a* is provided with: a cavity for forming an ink reservoir 1; and, ports forming part of a nozzle communicating ports 7. The supply port plate 3*a* is provided with ink supply ports 3 and ports forming part of the nozzle communicating ports 7. The pressure generating chamber plate 2*a* is provided with a plurality of cavities for forming a plurality of pressure generating chambers 2 each of which assumes an elongated shape. These pressure generating chambers 2 are arranged side-by-side in a direction perpendicular to their longitudinal axes, wherein the longitudinal axis of etch of the pressure generating chambers 2 horizontally extends in FIG. 16. On the other hand, the vibrating plate 4*a* is partitioned into a plurality of vibrating plate portions 4 each of which forms a bottom plate portion of each of the pressure generating chambers 2.

In fabricating the conventional ink jet recording head by connecting the above-mentioned various types of component plates with each other, for example, according to a method disclosed in Japanese Patent Application Laid-Open No. Sho57-91274, a liquid adhesive film is applied to each of opposite surfaces of a desired one of the component plates through a transfer printing process or an ordinary printing process, and thereby preparing an adhesive layer having a thickness of, for example, several $\mu$m. After completion of formation of the adhesive layer, these component plates are successively stacked vertically in a stack and bonded to each other under pressure to produce the conventional ink jet recording head.

At this time, in stacking vertically these component plates coated with the adhesive layers 9 (FIG. 17) in the stack under pressure, the adhesive layers 9 tend to flow out of their applied areas under the influence of pressure to enter an interior of each of the ink reservoir 1, the nozzle communicating ports 7 and the ink ejection nozzles 6. Occurrence of such flowing out of the adhesive layers 9 results in the following problem. Namely, as shown in FIG. 17, for example, in bonding the reservoir plate 1*a* to the supply port plate 3*a*, when the pressure applied to the reservoir plate 1*a*, and supply port plate 3*a* and/or the thickness of the adhesive layers are excessively large, an excess adhesive layer 10 tends to extrude into interiors of the nozzle communicating ports 7. Such extrusion of the excess adhesive layer 10 into the interiors of the nozzle communicating ports 7 increases friction losses in ink flow, which impairs smooth ejection of ink droplets 8 from the intended nozzles 6, or increases interference between the nozzles 6 to cause accidental ejection of ink droplets 8 from the nozzles 6 not intended.

Consequently, in order to prevent the above problem, Japanese Patent Application Laid-Open No. Hei5-330067 discloses a prior art teaching a means for permitting an excess amount of an adhesive layer to escape into a plurality of escape grooves 13 without occurring any problem, wherein: as shown in FIG. 18, the means is constructed of a plurality of nozzle grooves 12 and the plurality of the escape grooves 13 both of which nozzle grooves 12, and escape grooves 13 are formed in a flow passage plate 11. In this prior art, in bonding a drive plate (not shown) to the flow passage plate 11 using an adhesive 14 which has been applied to the entire surface of the flow passage plate 11 or of the drive plate (not shown) to form the adhesive layer, an excess amount of the adhesive 14 is capable of escaping into the escape grooves 13. Due to this, the amount of the adhesive 14 flowing into an interior of each of the nozzle grooves 12 may be reduced. As a result, it is possible for the conventional ink jet recording heat of this prior art to be stabilized in ink erection characteristics, and thereby improved in productivity in yield.

Further, the escape grooves 13 also may sometimes serve to function as air escape passages for permitting air trapped in a plate connection portion between adjacent component plates of the conventional ink jet recording head to escape into the atmosphere or outside.

However, in the prior art disclosed in the Japanese Patent Application Laid-Open No. Hei5-330067, as described above, the escape grooves 13 are provided essentially for a purpose of permitting the excess amount of the adhesive 14 having been applied to the entire surface of the flow passage plate 11 or of the drive plate (not shown) to escape from any critical area of the conventional ink jet recording head. In other words, the escape grooves 13 are not provided for the purpose of permitting the air trapped in the plate connection portion to escape into the atmosphere or outside. Consequently, in the prior art, the escape grooves 13 are often filled with the excess amount of the adhesive 13, and therefore often prevents the air trapped in the plate connection portion from escaping into the atmosphere or outside.

Presence of such air trapped in the plate connection portion impairs the plate connection portion in air-tightness. In other words, the presence of such air trapped in the plate connection portion prevents the plate connection portion from being brought into close contact with any one of the component plates of the conventional ink jet recording head. Further, since the air trapped in the plate connection portion increases or decreases in volume when subjected to a heating process step or a cooling process step during a stacking process of the component plates in which stacking process the component plates are stacked vertically in a stack and bonded to each other to form the conventional ink jet recording head, the adhesive layer is often separated from the corresponding component plates in use, which is called "peeling-off" of the adhesive layer and considerably impairs the conventional ink jet recording head in mechanical strength.

In a case in that the conventional ink jet recording head according to this prior art is constructed of three or more of the component plates stacked vertically in a stack and bonded to each other, even when the escape grooves 13 function to permit the air trapped in the plate connection portion to escape from the plate connection portion ino the atmosphere or outside, as shown in FIG. 16, it is not preferable to form these escape grooves 13 in each of the vibrating plate 4*a*, the supply port plate 3*a* and the nozzle plate 6*a* since a provision of the escape grooves 13 in the vibrating plate 4*a*, supply port plate 3*a* and nozzle plate 6*a* all of which are thin in thickness considerably impairs the vibrating plates 4*a*, supply port plate 3*a* and nozzle plate 6*a* in mechanical strength. Due to this, it is necessary for the conventional ink jet recording head to form the escape grooves 13 in opposite surfaces of each of the reservoir plate 1*a* and the pressure generating chamber plate 2*a* which are sandwiched between nozzle plate 6*a* and supply port plate 3*a* and between supply port plate 3*a* and vibrating plate 4*a*, respectively. However, since an area in which the escape grooves 13 are effectively arranged is limited, there is a danger that the escape grooves 13 are formed in opposite surfaces of a portion of each of the reservoir plate 1*a*, and pressure generating plate 2*a*, which portion is considerably impaired in mechanical strength due to a presence of the escape grooves 13 closely formed in such portion even when each of the reservoir plates 1*a* and pressure generating plate 2*a* is relatively thick in thickness.

Further, in the conventional ink jet recording head, since the adhesive layer is applied to the entire surface of the flow passage plate 11, there still is danger of some inevitable protrusion of an excess amount of the adhesive layer into the nozzle grooves 12 even when the adhesive is strictly controlled in quantity.

SUMMARY OF THE INVENTION

In view of the above, it is an object of the present invention to provide an ink jet recording head and a method for manufacturing a same, which are capable of: preventing an adhesive layer from protruding into any one of cavities for forming an ink flow passage system; and, permitting air (voids) trapped in a plate connection portion to easily escape from the plate connection portion to the atmosphere, whereby the ink jet recording head is stabilized in its ink ejection characteristics, and an improved yield in productivity.

According to a first aspect of the present invention, there is provided an ink jet recording head wherein including: a nozzle plate provided with a nozzle through which ink is ejected; one or more of fluid passage plates which include at least one pressure generating chamber for pressurizing the ink and further include a plurality of cavities for forming an ink flow passage system defined by one or more of the fluid passage plates; a vibrating plate for defining a sealed portion of the pressure generating chamber; a piezoelectric actuator for pressurizing the ink of the pressure generating chamber by displacing the vibrating plate, wherein the piezoelectric actuator is connected with a portion of the vibrating plate corresponding in position to the pressure generating chamber; a plurality of adhesive layers, wherein each of the adhesive layers is inserted between adjacent plates of the nozzle plate, the fluid passage plates and vibrating plate to stack all the plates in a stack forming the ink jet recording head, an improvement wherein:

of the one or more of the fluid passage plates, at least one of the fluid passage plates is provided with an air passage for permitting air trapped in a plate connection portion between any adjacent ones of all the plates to escape out of the plate connection portion into the atmosphere when the ink jet recording head is manufactured; and the air passage is constructed of a plurality of groove portions intermittently provided in a vicinity of an edge of at least one of the plurality of cavities for forming the ink flow passage system in each of opposite surfaces of a corresponding one of the plates, wherein the air passage formed in one of the opposite surfaces of the corresponding plate and that formed in the other of opposite surfaces are offset from each other in a plane of the corresponding plate, and communicated with each other through a through-hole to permit the air trapped in the plate connection portion to flow alternately through the air passage of the one of the opposite surfaces of the corresponding plate and that formed in the other of the opposite surfaces, thereby permitting the air trapped in the plate connection portion to escape into the atmosphere.

In the foregoing, a preferable mode is one wherein the air passage provided in the vicinity of the edge of at least one of the pluraluty of cavities for forming the ink flow passage system in the corresponding plate extends to a side edge portion of the corresponding plate.

Also, a preferable mode is one wherein the corresponding plate is provided with an atmosphere communicating through-hole; and, the air passage provided in the vicinity of the edge of at least one of the plurality of cavities for forming the ink flow passage system in the corresponding plate extends to an edge portion of the atmosphere communicating through-hole.

Also, a preferable mode is one wherein each of the groove portions which forms the air passages and disposed in the vicinity of the edge of at least one of the plurality of cavities for forming the ink flow passage system is spaced apart from the edge of the cavity by a distance of from equal to or more than 100 $\mu$m to equal to or less than 600 $\mu$m.

Further, a preferable mode is one wherein an adhesive layer is inserted between adjacent ones of the plates in a peripheral portion of each of the cavities for forming the ink flow passage system.

Also, a preferable mode is one wherein the peripheral portion of the cavity for forming the ink flow passage system is within a range of from equal to or more than 100 $\mu$m to equal to or less than 600 $\mu$m from the edge of the cavity.

Also, a preferable mode is one wherein number of the plates for forming the ink flow passage system is an odd number more than three, wherein the plates for forming the ink flow passage system are provided with the plurality of the cavities which vary in function and shape, and all the cavities are combined with each other to form the ink flow passage system; and, an odd-numbered one or more of the plates for forming the ink flow passage system as counted from a side of the nozzle plate or from a side of the vibrating plate are provided with one or more air passage.

Also, a preferable mode is one wherein a first one of the plates for forming the ink flow passage system as counted from the nozzle plate is constructed of a reservoir plate stacked on others of the plates for forming the ink flow passage system, wherein the reservoir plate is provided with one of the cavities, which one forms an ink reservoir for storing the ink therein, the reservoir plate being further provided with an axial part of a nozzle communicating port through which the pressure generating chamber is communicated with the ink ejection nozzle to permit the ink to be supplied to the ink ejection nozzle; a second one of the plates for forming the ink flow passage system as counted from the nozzle plate is constructed of a supply port plate which is provided with an ink supply port and remaining axial part of the nozzle communicating port, wherein through the ink supply port the ink reservoir is communicated with the pressure generating chamber to permit the ink to be supplied to the pressure generating chamber; a third one of the plates for forming the ink flow passage system as counted from the nozzle plate is constructed of a chamber plate provided with one of the plurality of cavities, which one forms the pressure generating chamber; each of the first and the second one of the plates for forming the ink flow passage system is provided with one or more of the air passages; and, the first, the second and the third one of the plates for forming the ink flow passage system are stacked vertically in the stack in this order.

Also, a preferable mode is one wherein the through-hole is formed into a frustoconical shape having a larger one of its opposite end openings directed toward a source of ultraviolet radiation.

Further, a preferable mode is one wherein one of the adhesive layers is sandwiched between: a surface of one of the plates for forming the ink flow passage system, in which a surface of the larger one of the opposite end openings of the through-hole is formed; and, a surface of a corresponding one of the plates, which the corresponding one is disposed adjacent to the one of the plates; and, the one of the adhesive layers is a thermosetting adhesive layer capable of being cured when subjected to ultraviolet radiation.

Still further, a preferable mode is one wherein the through-hole is formed in an area spaced apart from the edge of the cavity for forming the ink flow passage system by a distance within a range of from equal to or more than 100 $\mu$m to equal to or less than 600 $\mu$m; and, the thermosetting adhesive layer is applied to the area within a range of from equal to or more than 100 $\mu$m to equal to or less than 600 $\mu$m from the edge of the cavity for forming the ink flow passage system.

According to a second aspect of the present invention, there is provided a method for manufacturing an ink jet recording head including: a nozzle plate provided with ink ejection nozzles through which ink is elected; one or more of fluid passage plates which include at least one pressure generating chamber for pressurizing the ink and further include a plurality of cavities for forming an ink flow passage System defined by one or more of the fluid passage plates; a vibrating plate for defining a sealed portion of the pressure generating chamber; a piezoelectric actuator for pressurizing the ink of the pressure generating chamber by displacing the vibrating plate, wherein the piezoelectric actuator is connected with the vibrating plate's portion corresponding in position to the pressure generating chamber; a plurality of adhesive layers, wherein each of the adhesive layers is inserted between adjacent plates of the nozzle plate, the fluid passage plates and the vibrating plate to stack all the plates into a stack forming the ink jet recording head, wherein at least one of the one or more of the fluid passage plates is provided with an air passage for permitting air trapped in a plate connection portion between any adjacent ones of all the plates to escape out of the plate connection portion to the atmosphere when the ink jet printing head is manufactured, wherein the air passage is constructed of a plurality of groove portions intermittently provided in the vicinity of an edge of at least one of the cavities for forming the ink flow passage system in each of opposite surfaces of a corresponding one of the plates, wherein the air passage formed in one of the opposite surfaces of the corresponding plate and that formed in the other of opposite surfaces are offset from each other in a plane of the corresponding plate, and communicated with each other through a through-hole to permit the air trapped in the plate connection portion to flow alternately through the air passage of the one of the opposite surfaces of the corresponding plate and that formed in the other of the opposite surfaces, thereby permitting the air trapped in the plate connection portion to escape to the atmosphere, the method including the steps of:

intermittently providing a plurality of groove portions in each of opposite surfaces of at least one of the one or more of the flow passage plates so as to be disposed in the vicinity of an edge of at least one of the cavities for forming the ink flow passage system, wherein the groove portions are staggered in arrangement not to have their front groove portions aligned with their rear groove portions in cross section, wherein the front groove portions are communicated with the rear groove portions through a through-hole to form the air passage; and permitting the air trapped in the plate connection portion to escape from the connection portion when the plates are stacked vertically in a stack.

In the foregoing second aspect, a preferable mode is one wherein: in fabricating at least one of the one or more of the flow passage plates, a plurality of the through-holes are provided in opposite surfaces of at least one of the flow passage plates in a manner such that the through-holes are disposed in the vicinity of the edge of at least one of the plurality of cavities for forming the ink flow passage system; and, the plurality of the groove portions connect adjacent ones of the through-holes with each other, and are arranged not to align with each other in cross section of at least one of the flow passage plates to form the air passage for permitting the air trapped in the plate connection portion between the adjacent ones of all the plates to escape out of the plate connection portion to the atmosphere when the plates are stacked vertically in the stack.

Also, a preferable mode is one wherein a plurality of the through-holes are intermittently provided in one of opposite surfaces of at least one of the one or more of the flow passage plates in a manner such that the through-holes are disposed in the vicinity of the edge of at least one of the cavities for forming the ink flow passage system; a plurality of the through-holes are intermittently provided also in the other of the opposite surfaces of the at least one of the one or more of the flow passage plates in a manner such that each of the through-holes extends between corresponding rear surfaces of adjacent ones of the groove portions formed in the one of the opposite surfaces, wherein a plurality of the through-holes are formed in portions where the groove portions formed in the one of the opposite surfaces are aligned with those formed in the other of the opposite surfaces in cross section of the at least one of the flow passage plates, and thereby forming the air passages; and, the air passage permit the air trapped in the plate connection portion between the adjacent ones of all the plates to escape out of the plate connection portion to the atmosphere when the plates are stacked vertically in the stack.

Preferably, the air passage formed in the vicinity of the edge of the at least one of the cavities for forming the ink flow passage system in the corresponding plate extends to a side edge portion of the corresponding plate.

Also, a preferable mode is one wherein the air passage formed in the vicinity of the edge of the at least one of the cavities for forming the ink flow passage system in the corresponding plate extends to a side edge portion of the corresponding plate.

Also, a preferable mode is one wherein the air passage formed in the vicinity of the edge of the at least one of the cavities for forming the ink flow passage system in the corresponding plate extends to an edge portion of the atmosphere communicating through-hole.

Also, a preferable mode is one wherein each of the groove portions which form the air passage is spaced apart from the edge of each of the cavities by a distance of more than 100 $\mu$m.

Also, a preferable mode is one wherein: in the step of intermittently providing the groove portions in the opposite surfaces of the at least one of the flow passage plates to form the air passage, opposite surfaces of the corresponding plate are simultaneously subjected to a half etching process called a "double-side half etching process", so that the plurality of the groove portions are intermittently formed in the opposite surfaces of the corresponding plate in a manner such that the groove portions formed in one of the opposite surfaces are offset from the groove portions formed in the other of the opposite surfaces in cross section of the corresponding plate; and, the through-holes are formed in portions where the groove portions formed in the one of the opposite surfaces are aligned with the groove portions formed in the other of the opposite surfaces in cross section of the corresponding plates, and thereby forming the air passages in the corresponding plate.

Also, a preferable mode is one wherein the opposite surfaces of the corresponding plate are simultaneously subjected to the double-side half etching process, whereby both the cavities for forming the ink flow passage system and the air passage are simultaneously formed in the corresponding plate.

Also, a preferable mode is one wherein, when adjacent ones of the plates are stacked together in bonding them to each other, the adhesive layer is applied to a peripheral portion of each of the cavities for forming the ink flow passage system between the adjacent ones of the plates.

Also, a preferable mode is one wherein the peripheral portion of each of the cavities is spaced apart from the edge of each of the cavities by a distance of equal to or more than 100 $\mu$m, provided that the distance does not exceed a value of 600 $\mu$m at maximum.

Also, a preferable mode is one wherein number of the plates for forming the ink flow passage system is an odd number more than three, wherein the plates for forming the ink flow passage system are provided with the plurality of the cavities which vary in function and shape, and all the cavities are combined with each other to form the ink flow passage system; and, an odd-numbered one or more of the plates for forming the ink flow passage system as counted from a side of the nozzle plate or from a side of the vibrating plate which is not counted are provided with one or more of the air passages.

Still further, a preferably:

a first one of the plates for forming the ink flow passage system as counted from the nozzle plate is constructed of a reservoir plate stacked on others of the plates for forming the ink flow passage system, wherein the reservoir plate is provided with one of the cavities, which one forms an ink reservoir for storing the ink therein, the reservoir plate being further provided with an axial part of a nozzle communicating port through which the pressure generating chamber is communicated with the ink ejection nozzle to permit the ink to be supplied to the ink ejection nozzle; a second one of the plates for forming the ink flow passage system as counted from the nozzle plate is constructed of a supply port plate which is provided with an ink supply port and remaining axial part of the nozzle communicating port, wherein through the ink supply port he ink reservoir is communicated with the pressure generating chamber to permit the ink to be supplied to the pressure generating chamber; a third one of the plates for forming the ink flow passage system as counted from the nozzle plate is constructed of a chamber plate provided with one of the cavities, which one forms the pressure generating chamber; each of the first and the second one of the plates for forming the ink flow passage system is provided with one or more of the air passages; and, the first, the second and the third one of the plates for forming the ink flow passage system are stacked vertically in the stack in this order.

Also, a preferable mode is one wherein the through-hole is formed into a frustoconical shape having a larger one of its opposite end openings directed toward a source of ultraviolet radiation.

Further, a preferable mode is one wherein one of the adhesive layers is sandwiched between: a surface of one of the plates for forming the ink flow passage system, in which a surface of the larger one of the opposite end openings of the through-hole is formed; and, a surface of a corresponding one of the plates, which corresponding one is disposed adjacent to the one of the plates; and, the one of the adhesive layers is a thermosetting adhesive layer capable of being cured when subjected to ultraviolet radiation.

Still further, a preferable mode is one wherein the through-hole is formed in an area spaced apart from the edge of the cavity for forming the ink flow passage system by a distance within a range of from equal to or more than 100 $\mu$m to equal to or less than 600 $\mu$m; and, the thermosetting adhesive layer is applied to the area within a range of from equal to or more than 100 $\mu$m to equal to or less than 600 $\mu$m from the edge of the cavity for forming the ink flow passage system.

As described above, since the adhesive is applied to only a narrow limited area, there is substantially no excess adhesive in the plate connection portion between any adjacent ones of all the component plates of the ink jet recording head, and, therefore there is substantially no danger that: the extrusion of the adhesive layer in to each of the ink ejection nozzles from the plate connection portion causes interference between the individual ink ejection nozzles, and increases friction losses in ink flow. Further, in addition to the fact that the adhesive is applied to only such narrow limited area, since various types of the cavities which form the ink flow passage system are provided in the opposite side portions of the adhesive layer together with the groove portions and the through-holes both of which form the air passages, any bubble of air (void) which is apt to be trapped in the plate connection portion may escape from the plate connection portion to the atmosphere through the ink flow passages and the air passages.

Further, since each of the air passages runs along the front surface and the rear surface of the corresponding component plate alternately in a zigzag manner, it is possible for the ink jet recording head to remove any bubble of air from the front surface and the rear surface of the individual component plate without tail.

In addition, since it is not required for the air passages to be separately provided in the front surface and the rear surface of the corresponding component plate of the ink jet recording head, there is no danger that such corresponding component plate is impaired in mechanical strength.

Further, when the through-hole is formed into a frustoconical shape having a larger one of its opposite end openings directed toward a source of ultraviolet radiation in a condition in which a component plate forming the other smaller end opening of the through-hole is bonded to another component plate disposed adjacent thereto through an adhesive layer of a thermosetting adhesive which is capable of being cured when subjected to ultraviolet radiation, it is possible to further improve the plate connection portion in air-tightness.

Consequently, it is possible to further improve the ink jet recording head both in air-tightness and in mechanical strength. Due to this, the ink jet recording head of the present invention is remarkably stabilized in ink ejection characteristics (recording quality), which results in yield-enhancement of the ink jet recording head in production.

BRIEF DESCRIPTION OF THE DRAWINGS

The above and other objects, advantages and features of the present invention will he more apparent from the following description taken in conjunction with the accompanying drawings in which:

FIG. 3A is a plan view of a front surface of an essential part of the ink jet recording head shown in FIG. 1, illustrating air passages provided in a vicinity of a nozzle communicating port of a reservoir plate;

FIG. 3B is a plan view of a rear surface of the essential part of the jet recording head shown in FIG. 1, illustrating the air passages provided in the vicinity of the nozzle communicating port of the reservoir plate;

FIG. 6 is a plan view of an essential part of an adhesive layer subjected to a compression process, illustrating its behavior under compression;

FIG. 9B is a plan view of the rear surface of the reservoir plate of the second embodiment, illustrating the configurations of the air passages provided in the vicinity of the nozzle communicating port;

DETAILED DESCRIPTION OF THE PREFERRED EMBODIMENTS

The best modes for carrying out the present invention will be described in detail using embodiments of the present invention with reference to the accompanying drawings.

First Embodiment

Figure 1:
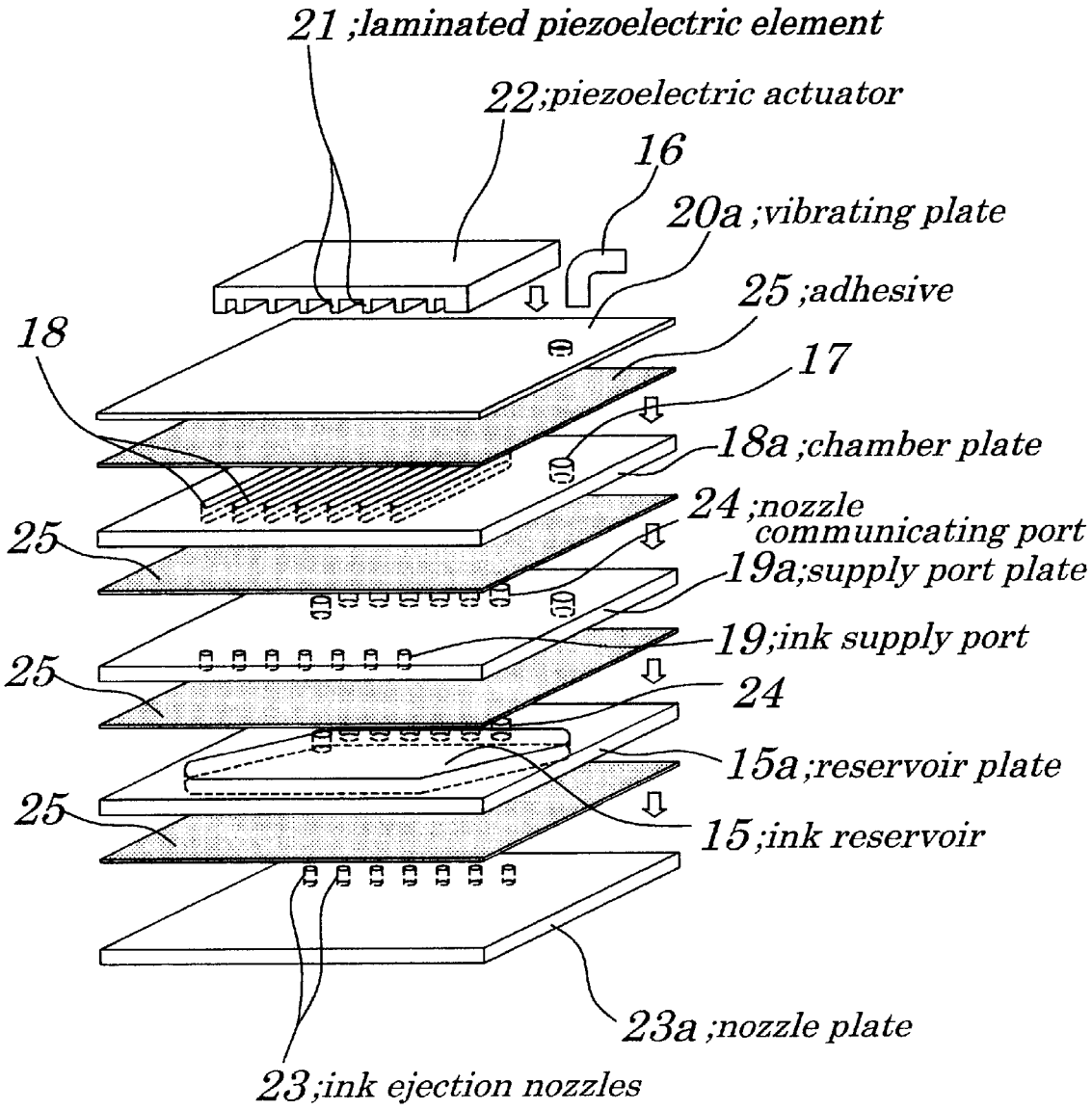
FIG. 1 is an exploded perspective view of an ink jet recording head of a first embodiment of the present invention.

FIG. 1 shows a first embodiment of an ink jet recording head of the present invention mounted on an ink jet recording apparatus or printer.

An ink jet recording head of a first embodiment remarkably differs from a conventional ink jet recording head in having: air passages in each of an ink reservoir plate (hereinafter referred to simply as a reservoir plate) 15*a* and a pressure generating chamber plate (hereinafter referred to simply as a chamber plate) 18*a*, wherein the air passages serve to permit air trapped in a plate connection portion between component plates of the ink jet recording head to escape from the plate connection portion to the atmosphere when the ink jet recording head is fabricated; and, an adhesive layer provided in a peripheral portion of each of cavity portion which forms an ink flow passage system constructed of an ink reservoir 15, a pressure generating chamber 18, an ink supply port 19, a nozzle communicating port 24, and like cavity portions.

In other words, the ink jet recording head of the first embodiment relates to an improvement of the conventional ink jet recording head of a Kyser system having a plate stack construction.

Figure 2:
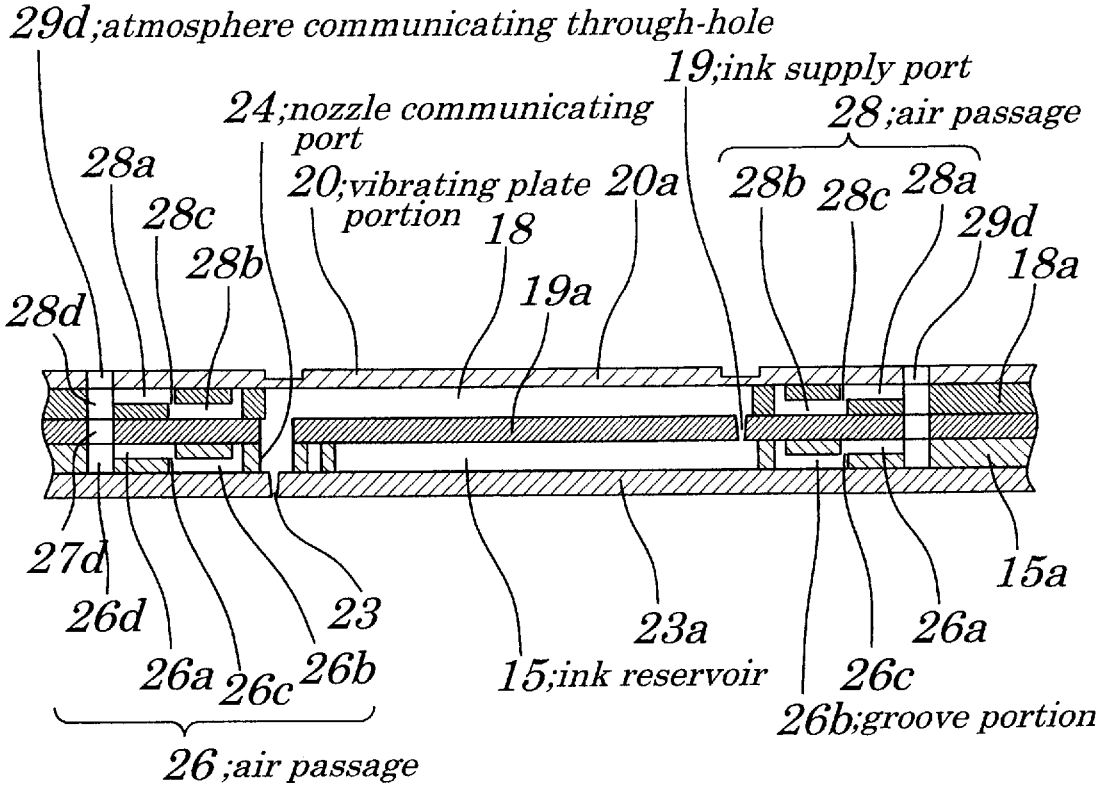
FIG. 2 is a sectional view of the ink jet recording head shown in FIG. 1.

As shown in FIG. 1 and FIG. 2, the ink jet recording head of the first embodiment includes: an ink reservoir 15 for storing ink therein; an ink introduction port 17 through which ink is supplied from an ink cartridge 16 to the ink reservoir 15; a plurality of pressure generating chambers 18, the number of which is seven, wherein each of the pressure generating chambers 18 assumes an elongated shape arranged side-by-side in a direction perpendicular to its longitudinal axis; a plurality of ink supply ports 19, the number of which is seven, wherein each of the ink supply ports 19 serves to supply the ink from the ink reservoir to each of the pressure generating chambers 18; a plurality of vibrating plate portions 20, the number of which is seven, wherein each of the vibrating plate portions 20 serves to seal each of the pressure generating chambers 18; a piezoelectric actuator 22 provided with a plurality of laminated piezoelectric elements 21, the number of which is seven, wherein these laminated piezoelectric elements 21 assume elongated shapes, are arranged side-by-side in a direction perpendicular to their longitudinal axes and aligned with the vibrating plate portions 20; a plurality of ink ejection nozzles 23, the number of which is seven; and a plurality of nozzle communicating ports 24, the number of which is seven, wherein the nozzle communicating ports 24 are arranged side-by-side in a manner such that they correspond to the pressure generating chambers 18 and the ink ejection nozzles 23, respectively.

Further, as shown in FIG. 1 and FIG. 2, the ink jet recording head of this first embodiment has a plate stack construction in which a plurality of component plates such as a nozzle plate 23*a*, the reservoir plate 15*a*, a supply port plate 19*a*, the chamber plate 18*a*, a vibrating plate 20*a*, and the piezoelectric actuator 22 are stacked vertically in this order in a stack. At this time, an adhesive layer 25 is sandwiched between adjacent ones of these component plates of the ink jet recording head, so that the component plates are bonded to each other using the adhesive layers 25 to form the ink jet recording head having the above-mentioned plate stack construction.

As shown in FIG. 1, seven ink ejection nozzles 23 each of which has a diameter of approximately 25 $\mu$m are formed in the nozzle plate 23*a* constructed of a stainless steel sheet having a thickness of approximately 75 $\mu$m, wherein these ink ejection nozzles 23 are arranged in a row and spaced apart from each other at intervals of approximately 508 $\mu$m.

Further, the reservoir plate 15*a* is constructed of a stainless steel plate having a thickness of approximately 140 $\mu$m, and provided with: a cavity for forming the ink reservoir 15; an axial part of each of the nozzle communicating ports 24 each of which has a diameter of approximately 160 μm. These nozzle communicating ports 24 are arranged in a row and spaced apart from each other at intervals of approximately 508 μm so as to correspond to the ink ejection nozzles 23. As shown in FIGS. 2, 3A and 3B, the reservoir plate 15*a* is provided with a plurality of groove portions 26*a*, 26*b* in its opposite surfaces in a manner such that the groove portions 26*a*, 26*b* appear intermittently in each of the opposite surfaces thereof and are disposed around an edge "Pe" of the ink reservoir 15 and in the vicinity of an edge "Ne" of each of the nozzle communicating ports 24, wherein each of front groove portion 26*a* (shown in FIG. 3A) of the groove portions 26*a*, 26*b* is offset from each of rear groove portions 26*b* (shown in FIG. 3B) of the groove portions 26*a*, 26*b* in a direction of the longitudinal axis of each of the groove portions 26*a*, 26*b* by a distance of substantially equal to half the longitudinal length of each of the groove portions 26*a*, 26*b*. Further, each of the front groove portions 26*a* (shown in FIG. 3A) is communicated with each of the corresponding rear groove portions 26*b* (shown in FIG. 3B) through a through-hole 26C to form an air passage 26 which runs in a zigzag course through the reservoir plate 15*a*. In other words, the air passage 26 is constructed of the groove portions 26*a*, 26*b* and the through-hole 26C, and disposed in an area spaced apart from each of the edges "Pe", "Ne" by a distance of from 200 μm to 300 μm in the vicinity of each of the ink reservoirs 15 and the nozzle communicating ports 24.

As shown in FIG. 2, the air passage 26 disposed around the ink reservoir 15 is communicated with the atmosphere through an atmosphere communicating through-hole 26*d* formed in an appropriate portion of the reservoir plate 15*a*. On an other hand, the air passage 26 running in the vicinity of the edge "Ne" of each of the nozzle communicating ports 24 extends to a side edge portion of the reservoir plate 15*a* to communicate with the atmosphere.

Further, as shown in FIG. 2, the supply port plate 19*a* is constructed of a stainless steel plate having a thickness of approximately 75 μm, and provided with the ink supply ports 19, the remaining axial part of each of the nozzle communicating ports 24, a lower end portion of the ink introduction port 17 (Shown in FIG. 1), and an atmosphere communicating port 27*d* aligned with the atmosphere communicating through-hole 26*d* of the reservoir plate 15*a*.

On the other hand, the chamber plate 18*a* is constructed of a stainless steel plate having a thickness of approximately 120 μm, and provided with a plurality of cavities (hereinafter also referred to simply as pressure generating chambers 18) each of which assumes an elongated shape having a width of approximately 300 μm and a length of approximately 2 mm. The number of these pressure generating chambers 18 is seven. These pressure generating chambers 18 are arranged side-by-side in a direction perpendicular to their longitudinal axes. Further provided in the chamber plate 18*a* are: a middle portion of the ink introduction port 17; and, an air passage 28 running in a zigzag course between the opposite surfaces of the chamber plate 18*a* to intermittently appear in each of the opposite surfaces. As shown in FIG. 2, this air passage 28 is provided a plurality of front groove portions 28*a* in its front surface and a plurality of rear groove portions 28*b* in its rear surface in a manner such that each of the front groove portions 28*a* is offset from each of the rear groove portions 28*b* in a direction parallel to a plane of the chamber plate 18*a* so as to be intermittently disposed around the edge of each of the pressure generating chambers 18.

Further, each of the front groove portions 28*a* is communicated with each of the rear groove portions 28*b* through a through-hole 28*c*, as shown in FIG. 2. These groove portions 28*a*, 28*b* and the through-hole 28*c* are connected with each other to form the air passage 28, and disposed in an area spaced apart from the edge of each of the pressure generating chambers 18 by a distance of from 200 μm to 300 μm. In this first embodiment, as shown in FIG. 2, the air passage 28 disposed around the edge of each of the pressure generating chambers 18 is communicated with the atmosphere communicating through-hole 28*d* to permit the air trapped in the plate connection portion to escape from the plate connection portion to the atmosphere. The atmosphere communicating through-hole 28*d* is formed in a position in which the atmosphere communicating through-hole 28*d* is aligned with the corresponding atmosphere communicating through-hole 26*d*, and atmosphere communicating port 27*d* of the reservoir plate 15*a* and the supply port plate 19*a*.

On the other hand, the vibrating plate 20*a* is constructed of a nickel plate having a thickness of approximately 30 μm, and provided with seven vibrating plate portions 20 partitioned in the vibrating plate 20*a* for sealing each of the pressure generating chambers 18. Further provided in the vibrating plate 20*a* are an upstream end portion of the ink introduction port 17 and the atmosphere communicating through-hole 28*d* formed in a position in which the atmosphere communicating through-hole 28*d* is aligned with the corresponding atmosphere communicating through-hole 26*d* of the chamber plate 18*a*.

In this first embodiment: adhesive used therein is a thermosetting type epoxy-based adhesive; and, the adhesive layer 25 having a thickness of from approximately 1 μm to approximately 4 μm is formed in a peripheral portion of each of the cavities for forming the ink flow passage system in the plate connection portion provided between: the component plates 23*a* and 15*a* disposed adjacent to each other; the component plates 15*a* and 19*a* disposed adjacent to each other; the component plates 19*a* and 18*a* disposed adjacent to each other; and, the component plates 18*a* and 20*a* disposed adjacent to each other. Incidentally, through experiments, inventors of the present invention have discovered that optimum results are obtained when the thickness of the adhesive layer having been cured is within a range of from 1 μm to 4 μm, which thickness is capable of removing any trapped air of the adhesive layer from the adhesive layer while keeping sufficient mechanical strength of the adhesive layer.

Further, in this first embodiment, an area in which the adhesive layer 25 is formed is disposed within a range of from 200 μm to 300 μm from the edge of each of the cavities for forming the ink flow passage system.

Although FIG. 1 shows as if the adhesive layer 25 is formed over an entire surface of the corresponding component plate such as the vibrating plate 20*a* and the chamber plate 18*a*, the adhesive layer 25 is limited in its application area in each of the nozzle plate 23*a* and the reservoir plate 15*a* in a manner such that the adhesive layer 25 is formed within a range of from 200 μm to 300 μm from each of the edges "Pe", "Ne" of the nozzle communicating ports 24 and the ink reservoir 15. Further, in the plate connection portion between the reservoir plate 15*a* and the supply port plate 19*a*, the adhesive layer 25 is formed within a range of from 200 μm to 300 μm from each of the edges "Pe", "Ne" of the nozzle communicating ports 24 and the ink reservoir 15. On the other hand, in the plate connection portion between the supply port plate 19*a* and the chamber plate 18*a*, the adhesive layer 25 is formed within a range of from 200 μm to 300 μm from each of the edges of the pressure generating chambers 18 and the edge of the ink introduction port 17, the number of which pressure generating chambers 18 is seven. Further, in the plate connection portion between the chamber plate 18*a* and the vibrating plate 20*a*, the adhesive layer 25 is formed within a range of from 200 μm to 300 μm from each of the edges of the pressure generating chambers 18 and the edge of the ink introduction port 17, the number of pressure generating chambers 18 is seven.

Incidentally, as described above, since the groove portions 26*a*, 26*b*, 28*a*, 28*b* and through-holes 26*c*, 28*c* all of which form the air passages 26, 28 are spaced apart from the edge of each of the cavities for forming the ink flow passage system by a distance of from 200 μm to 300 μm, the adhesive layer 25 extends from the edge of each of the cavities for forming the ink flow passage system to reach the edge of each of the air passages 26, 28, but does not extend beyond these air passages 26, 28.

Next, with reference to FIGS. 1, 4A, 4B, 4C, 4D and 4E, method for manufacturing the ink jet recording head of the present invention will be described.

First, each of the component plates such as the nozzle plate 23*a*, the reservoir plate 15*a*, the supply port plate 19*a*, the chamber plate 18*a*, the vibrating plate 20*a* and the piezoelectric actuator 22 is individually prepared. In fabricating each of these component plates, a photoresist film (hereinafter referred to simply as a resist film) is applied to each of opposite surfaces of a substrate 30 such as a stainless steel plate, a nickel plate or a like, wherein the substrate 30 forms a preform of each of component plates of the ink let recording head of the present invention, and has a thickness of from 30 μm to 140 μm, which thickness varies in application Then, the substrate 30 coated with the resist film in each of its opposite surfaces is patterned, and then has its opposite surfaces simultaneously subjected to a half etching process called "double-side half etching process" to form desired ones of the air passages and the various types of the cavities for forming the ink flow passage system in the substrate 30.

Figure 4A:
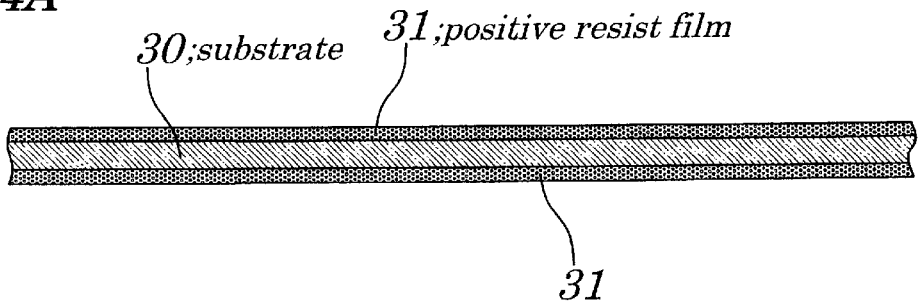
FIG. 4A is a sectional view a substrate forming a reservoir plate's preform in manufacturing the ink jet recording head shown in FIG. 1.
Figure 4B:
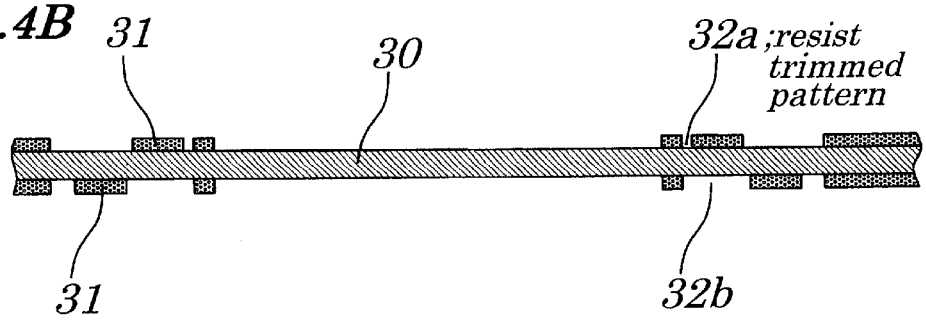
FIG. 4B is a sectional view of the preform of FIG. 4A, after completion of a patterning process thereof.
Figure 4C:
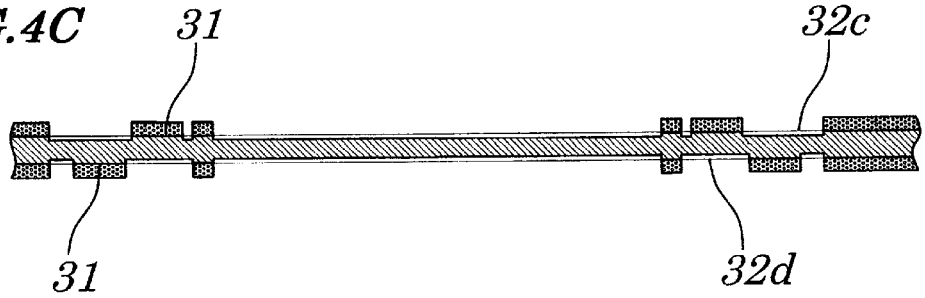
FIG. 4C is a sectional view of the preform of FIG. 4B, after completion of a double-side half etching process thereof.

For example, in fabricating the reservoir plate 15*a*, as shown in FIG. 4A, a positive resist film 31 is formed on each of the opposite surfaces of the substrate 30 by a spin coating process. Then, the positive resist films 31 thus formed on the opposite surfaces of the substrate 30 are simultaneously subjected to an exposure process, and after developed, to successively prepare a series of resist trimmed patterns 32*a*, 32*b*, 32*c* and 32*d*, as shown in FIGS. 4B and 4C, respectively.

Figure 4D:
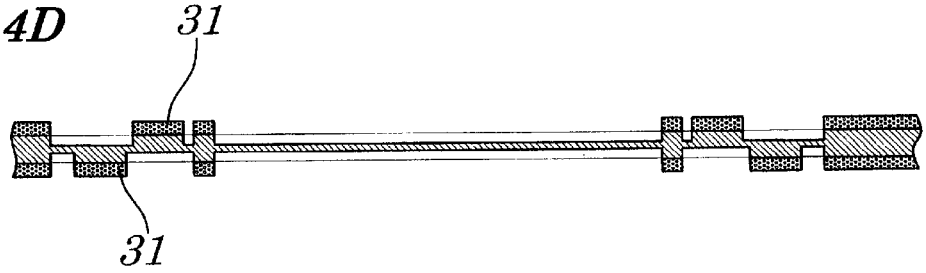
FIG. 4D is a sectional view of the preform of FIG. 4C, after completion of a post baking process of the patterned resist film of the preform.
Figure 4E:
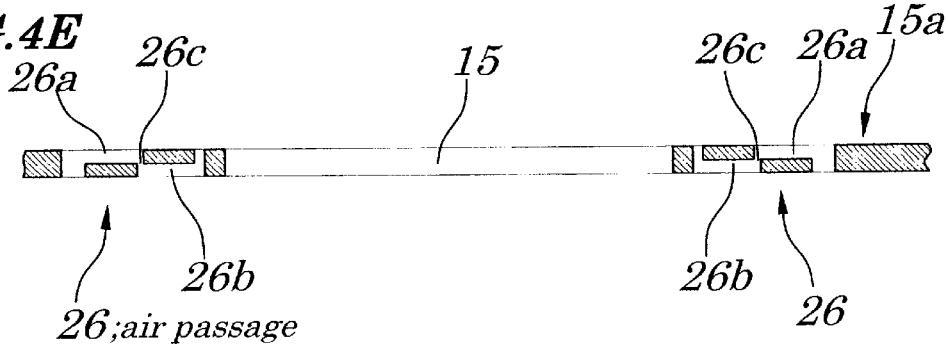
FIG. 4E is a sectional view of the preform of FIG. 4E, after completion of an additional double-side half etching process thereof.
Figure 5A:
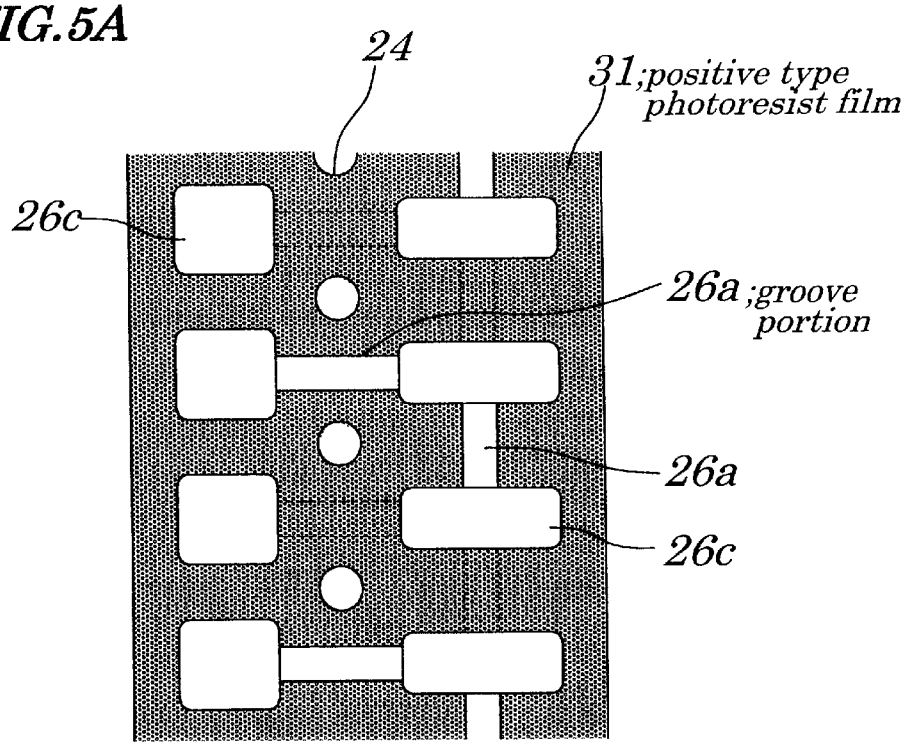
FIG. 5A is a front surface of the substrate forming the reservoir plate's preform in manufacturing the ink jet recording head shown in FIG. 1.
Figure 5B:
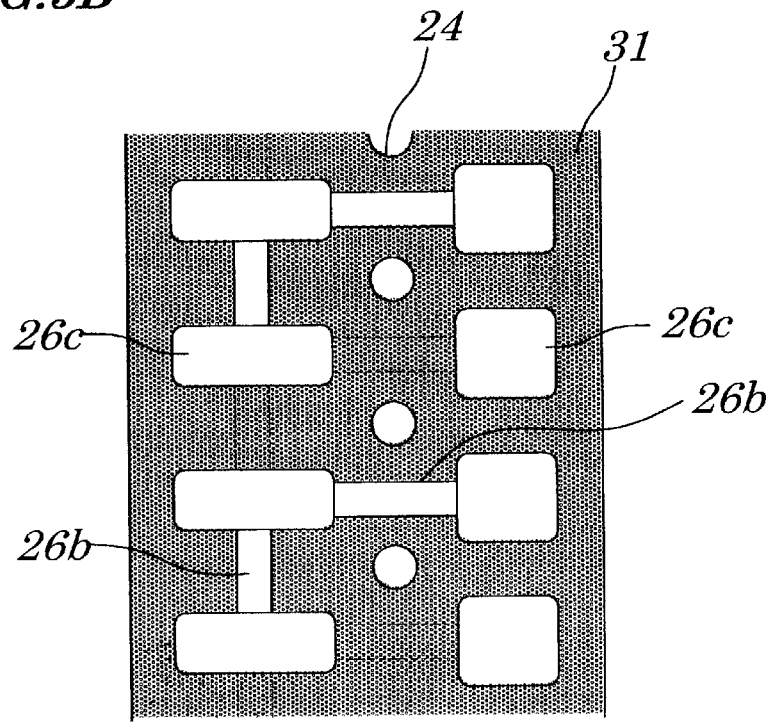
FIG. 5B is a rear surface of the substrate shown in FIG. 5A.

At this time, the resist trimmed patterns 32*a*, 32*b* of the resist film 31 for forming the ink reservoir 15, parts of the nozzle communicating ports 24 and parts of the through-holes 26*c* are substantially entirely aligned with each other in the opposite surfaces of the substrate 30, while the resist trimmed patterns 32*c*, 32*d* are formed in the opposite surfaces of the substrate 30 in a manner such that the patterned resist film 32*c* is offset from the patterned resist film 32*d* in a direction parallel to the plane of the substrate 30 by a distance equal to half the longitudinal length of each of the groove portions 26*a*, 26*b*, as shown in FIGS. 4E, 5A and 5B.

The thus patterned or trimmed resist film 31 is then subjected to a post-baking process. After that, as shown in FIGS. 4C and 4D, the thus treated substrate 30 has its opposite surfaces simultaneously subjected to a double-side half etching process.

In this double-side half etching process of the opposite surfaces of the substrate 30, the amount of substantially slightly more than half the thickness of the substrate 30 not covered with the resist film 31 is etched off from one of the opposite surfaces of the substrate 30, and thereby having the groove portions 26*a*, 26*b* forming the air passage 26 staggered along a straight line in a plane of the substrate 30 between the opposite surfaces of the substrate 30. On the other hand, due to the above construction, as shown in FIG. 4E, the through-hole 26*c* which forms each of the ink reservoir 15, the nozzle communicating port 24, and the air passage 26 is formed as a fully etched-off hole in the double-side half etching process, so that the reservoir plate 15*a* of the first embodiment is completed. Incidentally, the chamber plate 18*a* is also fabricated in a substantially similar way described above by using the double-side half etching process of the opposite surfaces of the substrate 30. Further, though each of the nozzle plate 23*a*, the supply port plate 19*a* and the vibrating plate 20*a* is provided with no groove portion for forming the air passage and no through-hole, each of these plates 23*a*, 19*a*, 20*a* may be fabricated in a substantially similar way described above by using the double-side half etching process of the opposite surfaces of the substrate 30.

Now, the adhesive layer 25 is applied to a corresponding connection surface of each of the various component plates 23*a*, 15*a*, 19*a*, 18*a*, 20*a* and a corresponding connection surface of the piezoelectric actuator 22 by using a suitable printing process such as offset printing processes, letterpress printing processes, screen printing processes, pad-printing processes, transfer printing processes such as stamp transfer printing processes, and like known printing processes. Preferably, the adhesive layer 25 is applied to only one of the corresponding connection surfaces of the component plates, through which connection surfaces these component plate should be bonded to each other through the adhesive layer 25. In this first embodiment, the epoxy-based adhesive layer 25 having a thickness of from 2 μm to 4 μm is formed only within a range of from 200 μm to 300 μm from the edge of each of the cavities for forming the ink flow passage system. After completion of the formation of the epoxy-based adhesive layer 25, the component plates 23*a*, 15*a*, 19*a*, 18*a*, 20*a* are stacked vertically in a stack in this order, bonded to each other under pressure, and heated to cure the epoxy-based adhesive 25 to produce the ink jet recording head of the first embodiment.

In the above bonding conditions of the component plates in the stack, since the thickness of the adhesive layer 25 which is still not cured is within a range of from 2 μm to 4 μm and therefore relatively thin, and further since the area covered by the adhesive layer 25 has a width of from 200 μm to 300 μm and therefore relatively narrow, an excess amount of the adhesive layer 25 extruding into the interior of each of the groove portions 26*a*, 26*b*, 28*a*, 28*b* and the through-holes 26*c*, 28*c* which form the air passages 26, 28 together with the cavities for forming the ink flow passage system is very little, and therefore negligible even when the stack of the component plates are vertically compressed.

The behavior of the adhesive layer 25 extending in the peripheral portion of each of the cavities for forming the ink flow passage system is as follows in the compression process of the stack of the component plates: namely, when the adhesive layer 25 disposed in an area inside a bisector boundary which bisects the adhesive layer 25 in volume, to form an inner and an outer half of the adhesive 25, is compressed, the adhesive layer 25 moves toward the cavities, as shown in FIG. 3A. In contrast with this, when the adhesive layer 25 disposed in an area outside such bisector is compressed, the adhesive layer 25 moves away from the cavities, and therefore moves toward the groove portions

26*a*, 26*b* and the through-holes 26*c*, 28*c* forming the air passages 26, 28. It is possible to find the bisector boundary of the adhesive layer 25 through experiments and computer simulations. As shown in FIG. 3A, an example of the bisector boundary of the adhesive layer 25 is denoted by a reference letter "A". The bisector boundary is constructed of a closed surface "A" which has been determined as to the adhesive layer 25 extending around the nozzle communicating port 24 of the reservoir plate 15*a*, shown in FIG. 3A where the closed surface "A" is shown as if it were a closed line.

On the other hand, as shown in FIG. 6, another bisector boundary constructed of another closed surface "B" has been determined as to the adhesive layer 33 extending around the nozzle communicating port 7 of the conventional reservoir plate. As shown in FIG. 3A, the bisector boundary "A" obtained in the first embodiment has a bisector diameter "Ar" as to the adhesive layer 25, a value of which bisector diameter "Ar" has been found to be within a range of from 0.35 mm to 0.4 mm, provided that center of the bisector diameter "Ar" is located at center of the nozzle communicating port 24 shown in FIG. 3A. In this first embodiment, since the nozzle communicating port 24 has a diameter of approximately 160 $\mu$m, the adhesive layer 25 disposed in an area spaced apart from the edge of the nozzle communicating port 24 by a distance of from 95 $\mu$m to 120 $\mu$m moves toward the nozzle communicating port 24 when subjected to the compression process.

Figure 17:
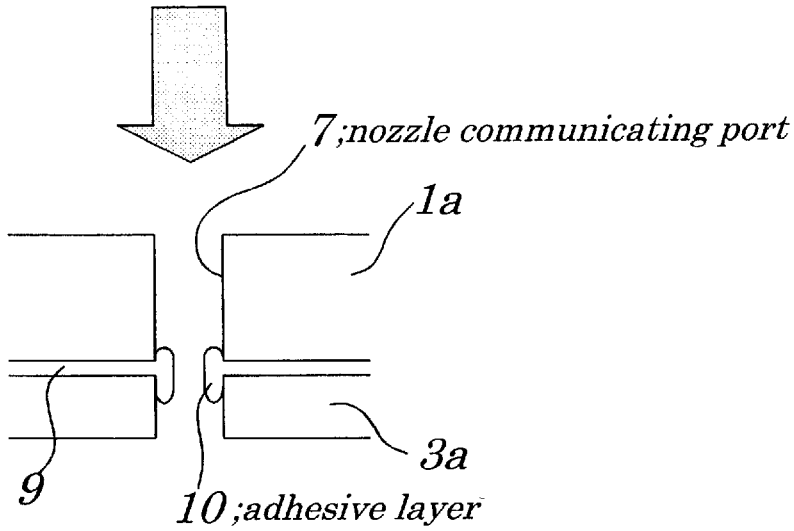
FIG. 17 (PRIOR ART)
FIG. 17 is a sectional view of an essential part of the conventional ink jet recording head of FIG. 15, illustrating a problem inherent in the conventional ink jet recording head.
Figure 18:
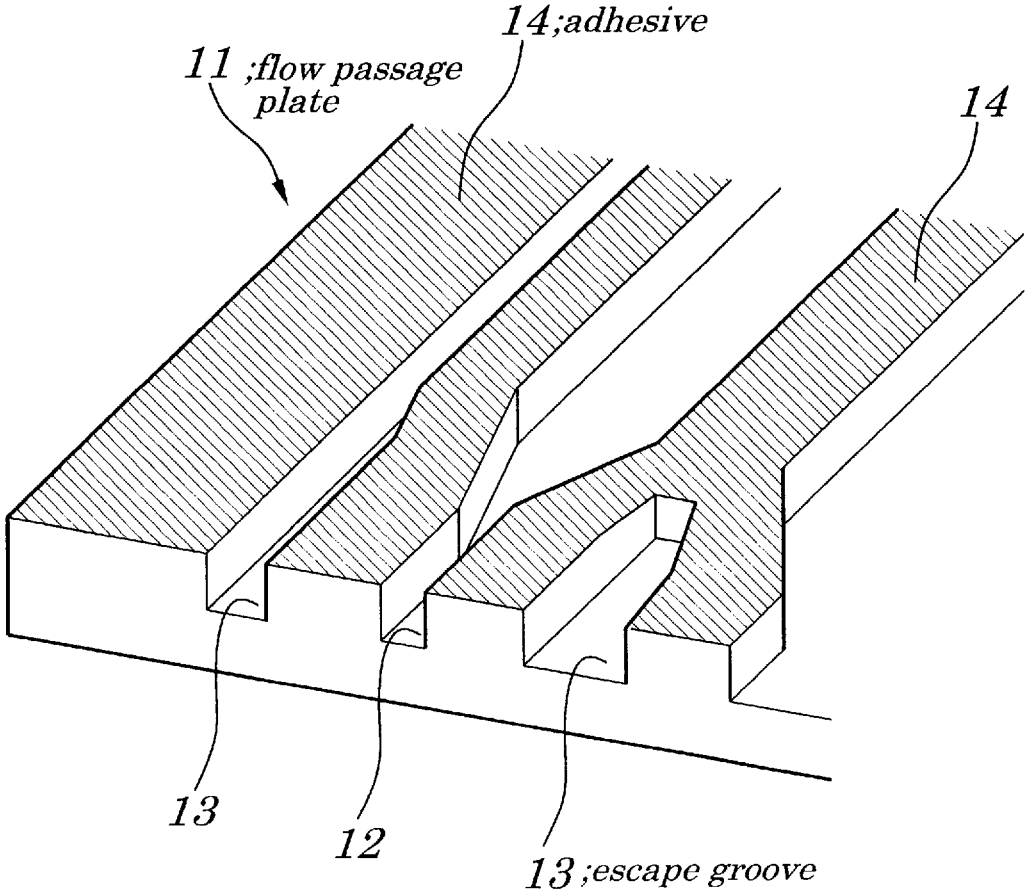
FIG. 18 (PRIOR ART)
FIG. 18 is a perspective view of an adhesive layer used in the conventional ink jet recording head of FIG. 15, illustrating the problem inherent in the conventional ink jet recording head.

In contrast with this, as shown in FIG. 6, the bisector boundary "B" has a bisector diameter "Br" as to the adhesive layer 33, a value of which bisector diameter "Br" has been found to be within a range of from 0.7 mm to 0.75 mm, provided that center of the bisector diameter "Br" is located at center of the nozzle communicating port 7 shown in FIG. 6. Consequently, in the stack of the component plates according to the prior art, as shown in FIG. 17, it is impossible to neglect the excess amount of the adhesive layer 33 extruding into the interior of each of the cavities for forming the ink flow passage system, the interior of each of the groove portions and the through-holes which form the air passages.

As described above, in the bonding process according to the first embodiment, since it is possible to reduce the thickness of the adhesive layer 25, and further since it is also possible to limit the application area of the adhesive layer 25 to a relatively narrow range, it is possible for the first embodiment to considerably reduce the excess amount of the adhesive layer 25 thus extruded. Consequently, in the first embodiment, there is no danger that interference occurs between the ink ejection nozzles 23 and that friction losses are increased in the ink flow. On the other hand, when the thickness of the adhesive layer 25 is reduced, air (void) is apt to be trapped in the adhesive layer 25 forming the plate connection portion. However, in the first embodiment, since the application area of the adhesive layer 25 is limited to a relatively narrow range, and further since there are provisions of the cavities for forming the ink flow passage system together with the provisions of the through-holes forming the air passages in the opposite side portions of the adhesive layers, it is possible for the trapped air (void) to easily escape from the adhesive layer 25 to the atmosphere through the ink flow passage system and the air passages.

Further, since each of the air passages runs in a zigzag course between the opposite surfaces (the front and the rear surface) of each of the component plates in a manner such that each of the air passages runs alternately along the front and the rear surface of each of the corresponding component plates, the air (void) trapped or remaining in the opposite surfaces of each of the corresponding component plates may easily escape from the plate connection portion or the adhesive layer 25 without fail.

Further, as described above, since there is no need of separately forming the air passage in each of the front and the rear surface of the corresponding component plate, there is no danger that the corresponding component plate is weakened/impaired in its mechanical strength due to such formation of the air passages in its opposite surfaces.

Consequently, it is possible for the first embodiment of the present invention to ensure its ink let recording head in both air-tightness and mechanical strength. Due to this, the ink jet recording head of the present invention is remarkably stabilized in its ink ejection characteristics (recording quality), and also improved in yield in manufacturing.

Second Embodiment

A second embodiment of an ink jet recording head of the present invention is shown in FIGS. 7A, 7B, 8, 9A and 9B.

This second embodiment differs from the first embodiment in having its ink ejection nozzles 23 arranged in four rows, in each of which rows: thirty-four pieces of the ink ejection nozzles 23 are spaced apart from each other at predetermined intervals, while the first embodiment has its ink ejection nozzles 23 arranged in only one row in which seven pieces of the ink ejection nozzles 23 are spaced apart from each other at predetermined intervals. In the second embodiment, since the ink ejection nozzles 23 are arranged in four rows, there are provided four pieces of the ink reservoirs 34. Further, in the second embodiment, since number of the ink ejection nozzles 23 is increased, number of corresponding pressure generating chambers 18 and that of corresponding nozzle communicating ports 35 are also increased.

Now, the behavior of reservoir plate 34*a* will be described in detail, as an example.

Figure 7A:
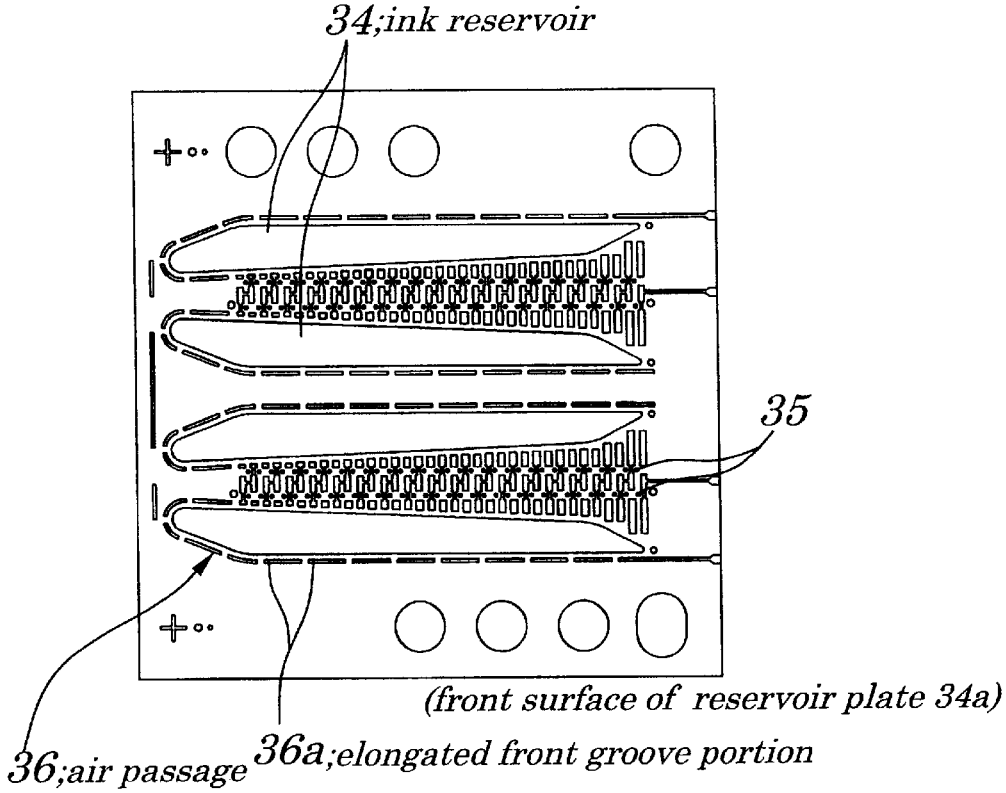
FIG. 7A is a plan view of a front surface of a reservoir plate used in a second embodiment of the present invention, illustrating a configuration of the reservoir plate.
Figure 7B:
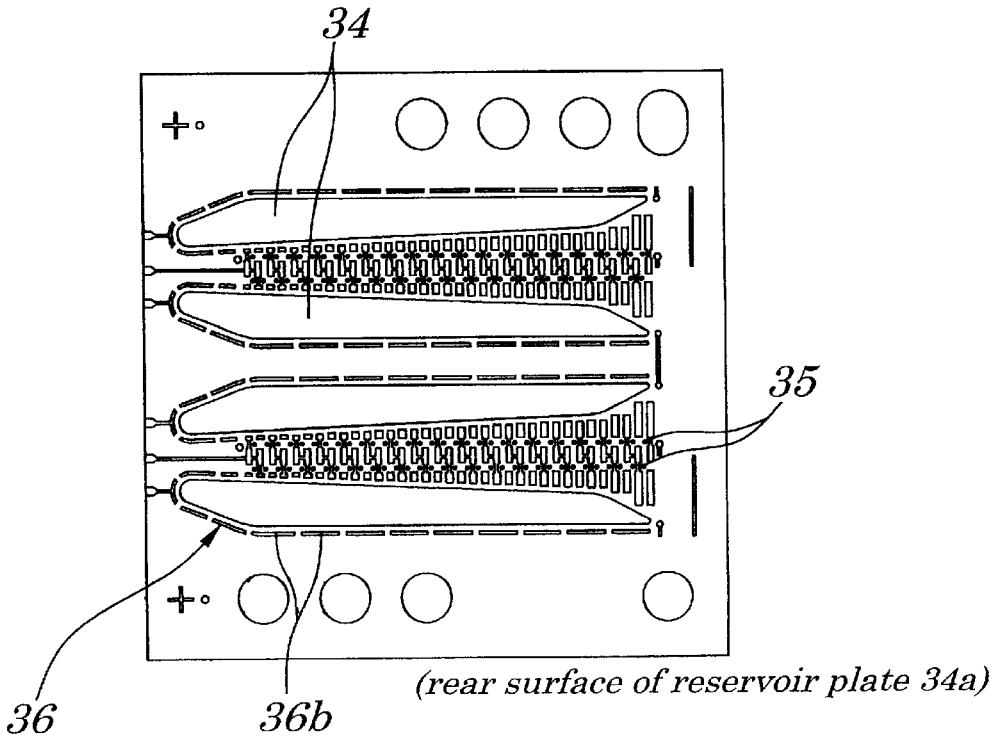
FIG. 7B is a plan view of a rear surface of the reservoir plate used in the second embodiment of the present invention, illustrating the configuration of the reservoir plate.
Figure 8:
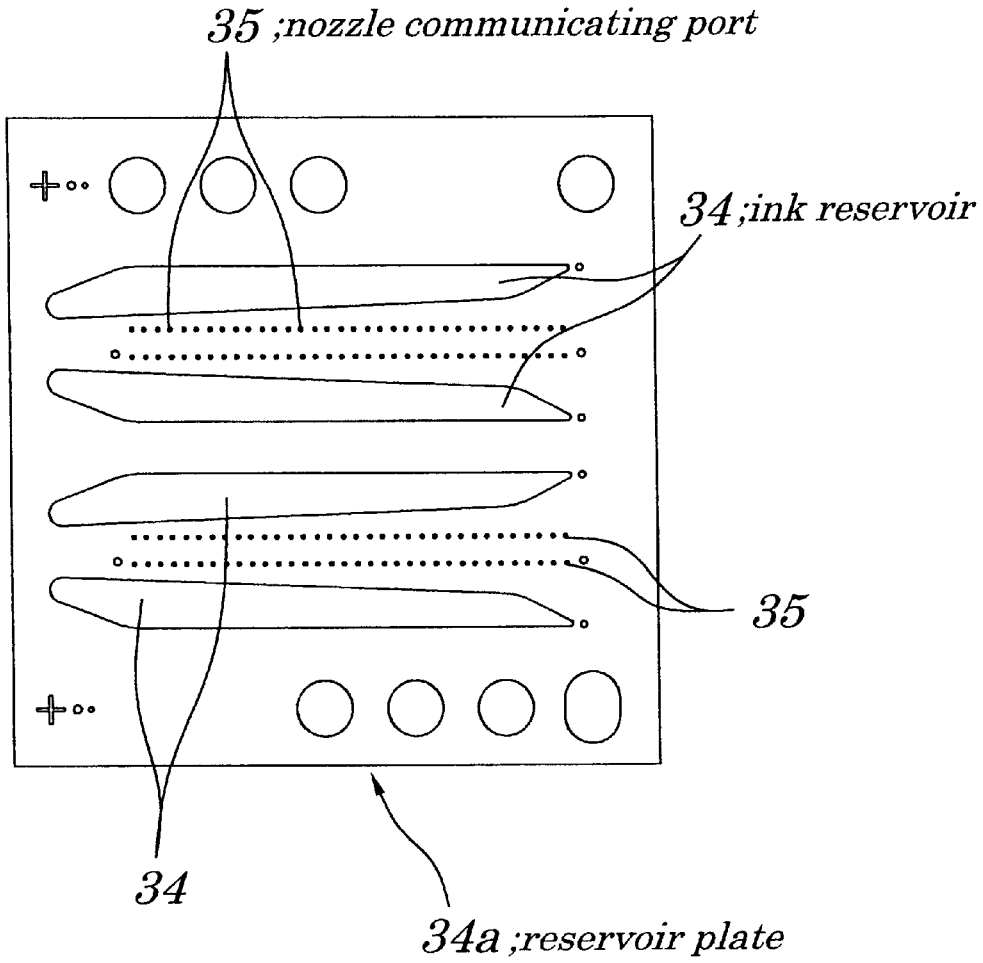
FIG. 8 is a plan view of the front surface of the reservoir plate shown in FIG. 7A, wherein air passages are omitted for clarification.

As shown in FIGS. 7A and 7B, each of air passages 36 is arranged around each of ink reservoirs 34, has a construction in which: as shown in FIG. 7A, a plurality of elongated front groove portions 36*a* are intermittently formed around the ink reservoir 34 by a half etching process in a front surface of the reservoir plate 34*a*; and, a plurality of elongated rear groove portions 36*b* are intermittently formed around the ink reservoir 34 by the half etching process in a rear surface of the reservoir plate 34*a*, wherein the elongated rear groove portions 36*b* are offset from the corresponding elongated front groove portions 36*a* so as to not align with the elongated front groove portions 36*a* in cross section of the reservoir plate 34*a* or in its plan view. In other words, each of the elongated rear groove portions 36*b* has an elongated bridge-like configuration for connecting adjacent ones of the corresponding elongated front groove portions 36*a*, and has its opposite end portions disposed in an overlapping relationship with the corresponding end portions of the elongated front groove portions 36*a* in the plan view of the reservoir plate 34*a*. Of a plurality of pairs of these overlapped end portions of the elongated front groove portions 36*a* and elongated rear groove portions 36*b*, at least one pair has its overlapped end portions connected with each other through a through-hole (not shown) such as the through-hole 26*c* of FIG. 1, wherein the through-hole (not shown) of the reservoir plate 34*a* is formed by the double-side half etching process for etching the opposite surfaces of the reservoir plate 34*a*. As is clear from FIG. 7A, in this second embodiment, any one of the air passages 36 reaches a side edge portion of the reservoir plates 34*a*.

Figure 9A:
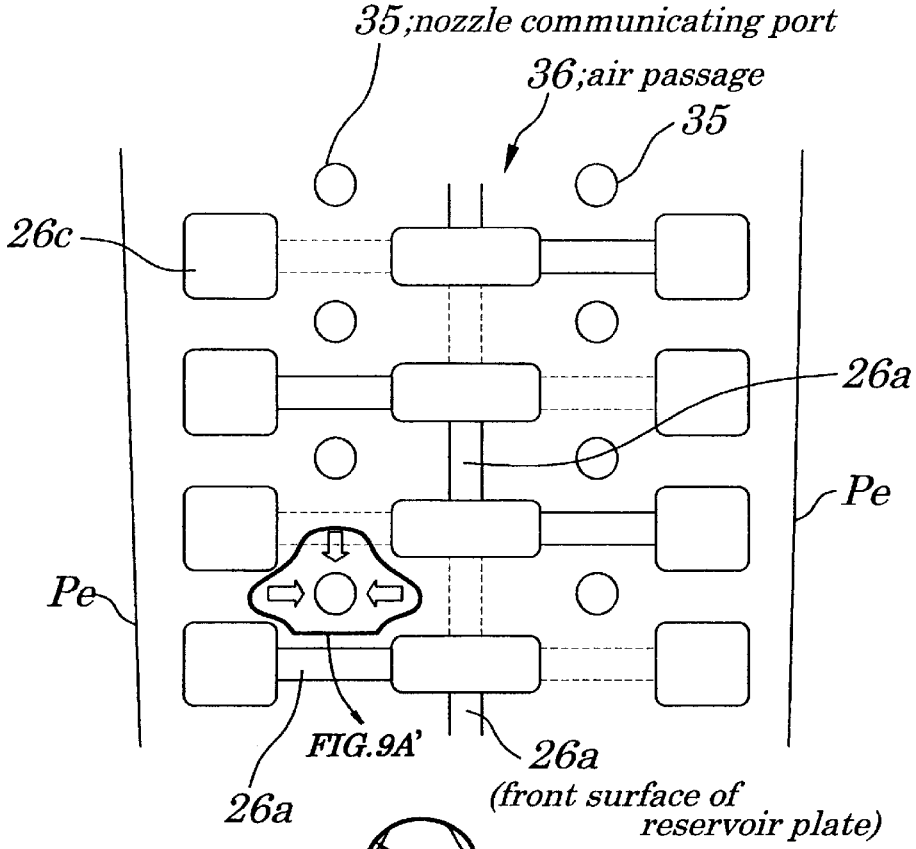
FIG. 9A is a plan view of the front surface of the reservoir plate of the second embodiment, illustrating configurations of the air passages provided in a vicinity of a nozzle communicating port.
Figure 9A:
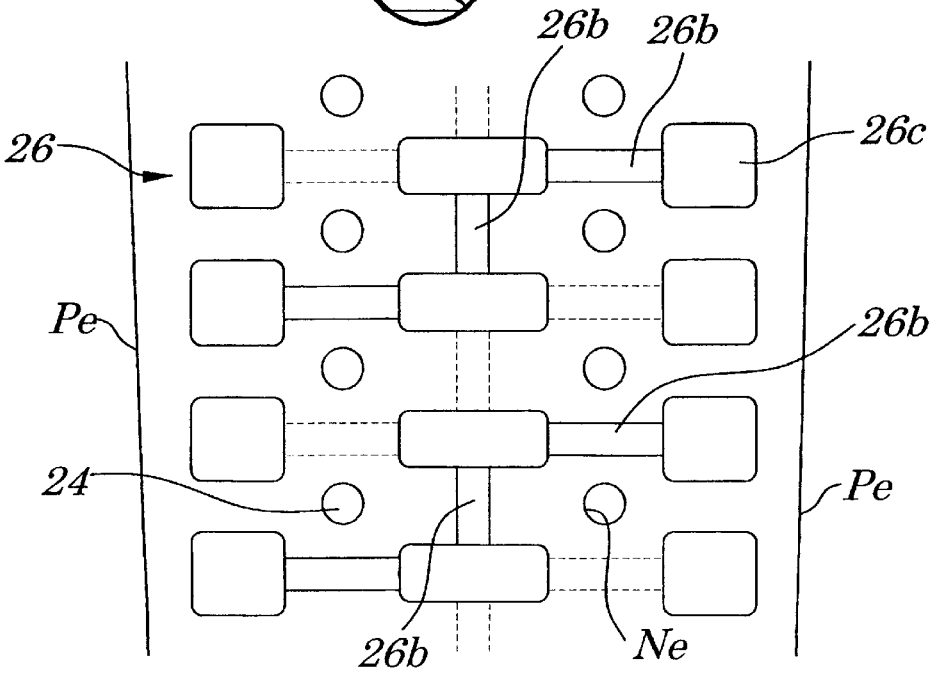

Incidentally, FIGS. 9A and 9B show the air passage 36 running in a vicinity of an edge of the nozzle communicating port 35, and correspond to FIGS. 3A and 3B of the first embodiment, respectively. Due to this, as for the air passage 36 shown in FIGS. 9A and 9B, its parts which are same as air passages 36 shown in FIGS. 3A and 3B, and therefore have been given the same reference numerals, and are not further described here in order to avoid redundancy in description.

As is clear from the above description, the second embodiment is capable of obtaining a same effect as that obtained in the first embodiment.

Third Embodiment

A third embodiment of an ink jet recording head of the present invention is shown in FIGS. 10, 11A, 11B, 12, 13A, 13B, 13C, 13D, 13E, 14A and 14B.

This third embodiment remarkably differs from the first embodiment in having: first, its through-hole formed into a frustoconical shape having a larger one of its opposite end openings directed toward a source of ultraviolet radiation, wherein the frustoconical through-hole forms an air passage for permitting air trapped or remaining in a plate connection portion (adhesive layer) to escape from the plate connection portion to atmosphere when the ink jet recording head is fabricated; and, second, its adhesive layer 125 made of a thermosetting adhesive which is capable of being cured upon exposure to heat and/or ultraviolet radiation, wherein such thermosetting adhesive layer is arranged in a peripheral portion of each of cavities for forming an ink flow passage system, which system is constructed of ink reservoirs 15, pressure generating chambers 18, ink supply ports 19, nozzle communicating ports 24, and a like in adjacent ones of component plates of the ink jet recording head.

Figure 10:
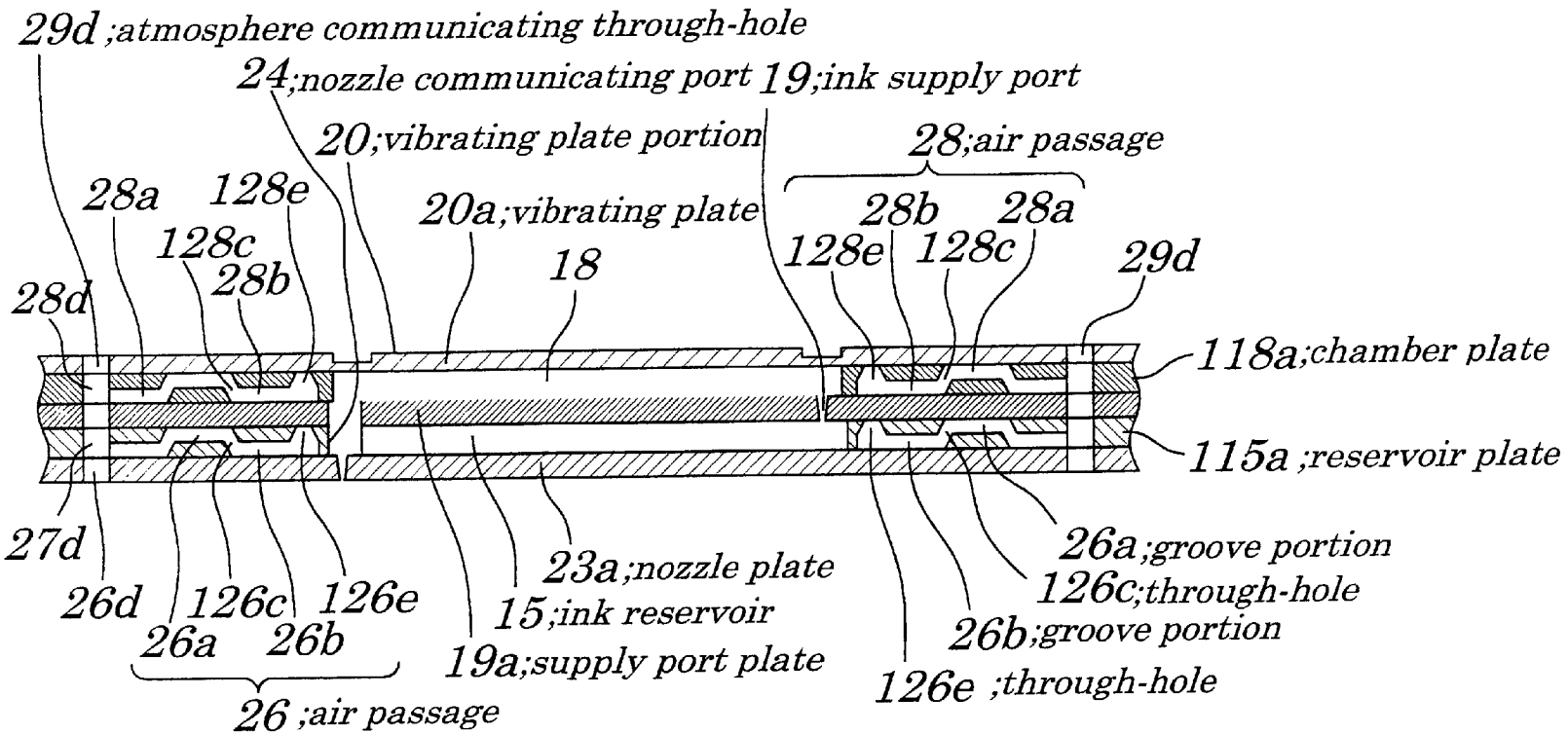
FIG. 10 is a sectional view of a third embodiment of the ink jet recording head of the present invention, illustrating a plate stack construction thereof.
Figure 11A:
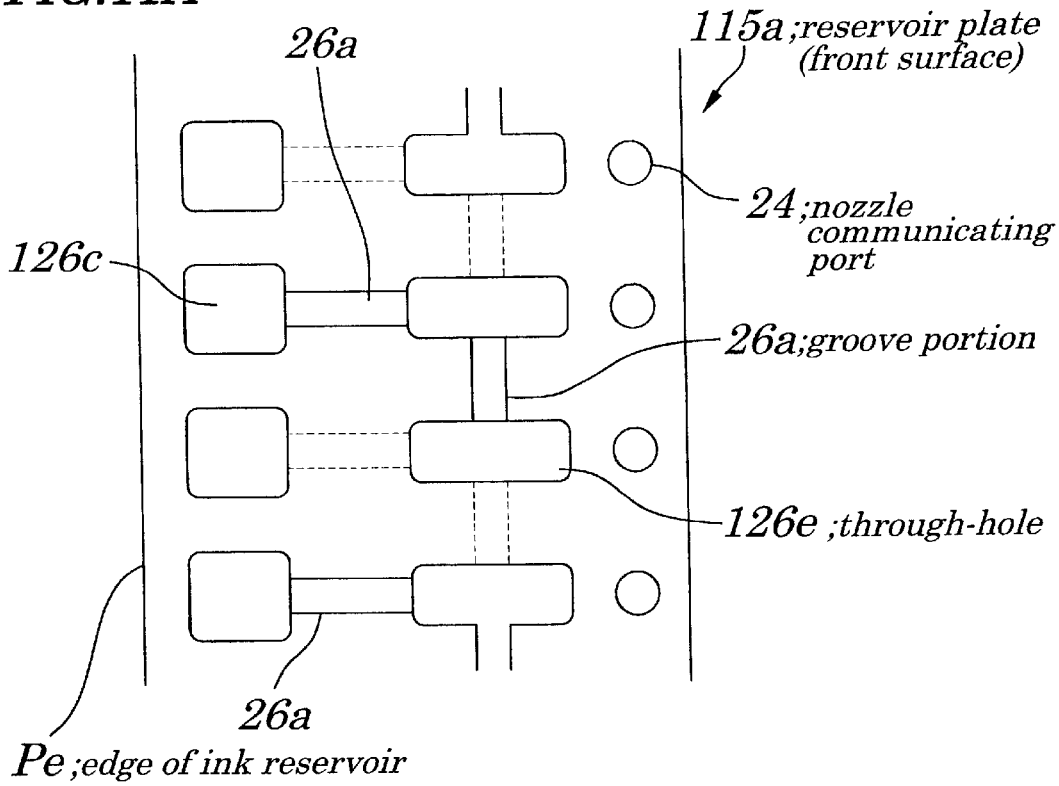
FIG. 11A is a plan view of a front surface of a reservoir plate of the third embodiment shown in FIG. 10, illustrating configurations of air passages provided in vicinity of a nozzle communicating port.
Figure 11B:
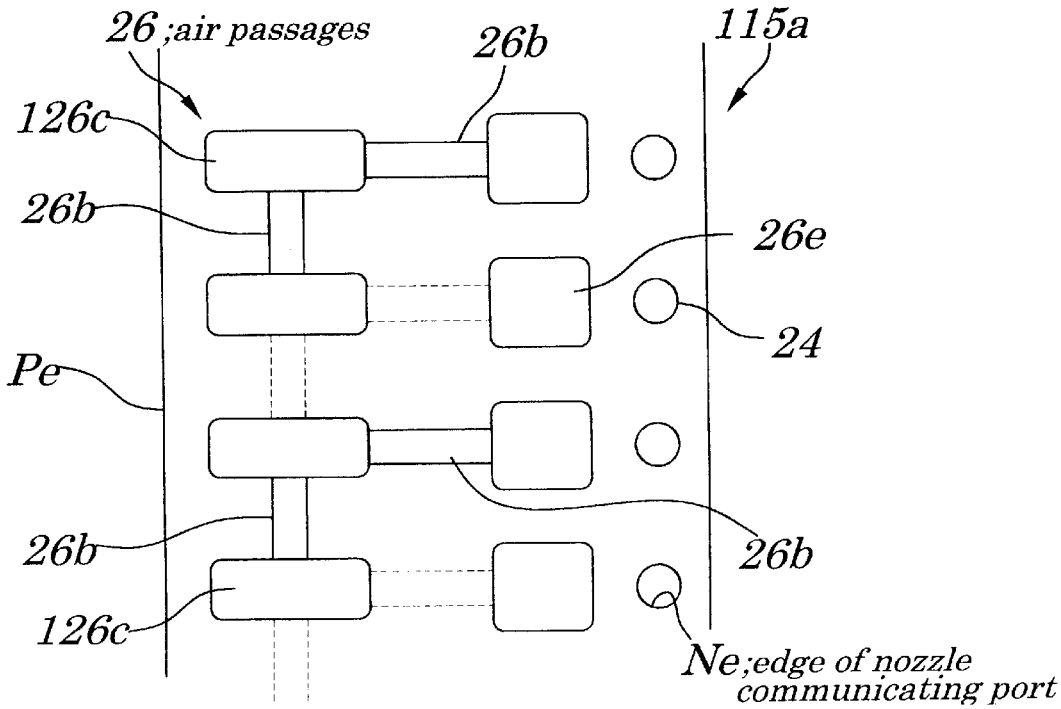
FIG. 11B is a plan view of a rear surface of the reservoir plate of the third embodiment shown in FIG. 10, illustrating the configurations of the air passages provided in the vicinity of the nozzle communicating port.

In other words, in the ink jet recording head of this third embodiment shown in FIG. 10, each of its through-holes 126*c*, 128*c*, 126*e* and 128*e* corresponding to the through-holes 26*c*, 28*c* and the remaining through-holes formed in the reservoir plate 15*a* and in the chamber plate 18*a* of the first embodiment is formed into a frustoconical shape (shown in FIG. 12), which shape has a larger one of its opposite end openings directed toward a source of ultraviolet radiation, as is in the first embodiment.

As is clear from FIG. 10, the reservoir plate 115*a* and the chamber plate 118*a* used in the third embodiment are denoted by the reference numerals 115*a* and 118*a*, respectively, and therefore correspond to the reservoir plate 15*a* and the chamber plate 18*a* of the first embodiment, respectively.

The above-mentioned thermosetting adhesive layer is used at least between nozzle plate 23*a* and the reservoir plate 115*a*, and between the supply port plate 19*a* and the chamber plate 118*a*, and is cured when exposed to heat and/or ultraviolet radiation. With respect to application area and thickness, there is substantially no difference between the thermosetting adhesive layer of the third embodiment and the adhesive layer of the first embodiment.

Incidentally, with respect to the remaining features, there is also substantially no difference between the third embodiment and the first embodiment. Consequently, in FIGS. 12, 13A, 13B, 13C, 13D and 13E, the parts which are same as ones used in the first embodiment have been given same reference numerals, and not further described here to avoid redundancy in description.

Now, method for manufacturing the ink jet recording head of the third embodiment will be described with reference to FIGS. 13A, 13B, 13C, 13D and 13E.

There is substantially no difference between the method for manufacturing the third embodiment and the method for manufacturing the first embodiment with respect to individual preparations of the component plates: the nozzle plate 23*a*, the supply port plate 19*a*, the vibrating plate 20*a* and the piezoelectric actuator 22. Further, with respect to: a thickness of each of stainless steel plates and nickel plates both used an preforms for preparing the component plates of the ink jet recording head; and, process steps for forming the cavities for forming the ink flow passage system in these component plates, there is substantially no difference between the method for manufacturing the third embodiment and the method for manufacturing the first embodiment.

Figure 13A:
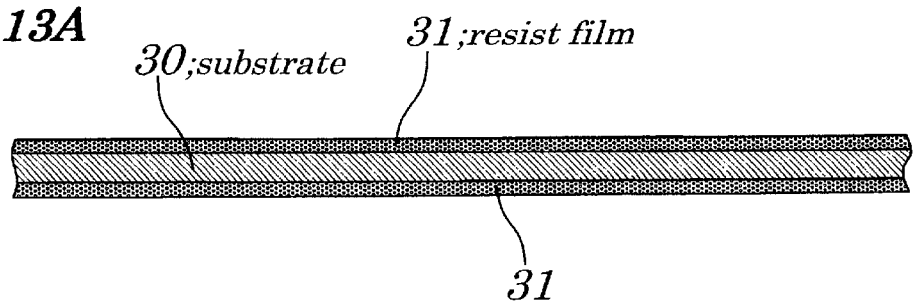
FIG. 13A is a sectional view a substrate which forms a reservoir plate's preform in manufacturing the ink jet recording head shown in FIG. 10.

The substrate 30 of the reservoir plate 115*a* is processed into the reservoir plate 115*a* as follows: first, as shown in FIG. 13A, for example, a positive type photoresist film 31 is formed in each of the opposite surfaces of the substrate 30 by a spin coating process; and, the substrate 30 has each of its coated opposite surfaces simultaneously subjected to an exposure process by the use of a predetermined photomask (not shown), and then developed to prepare a series of resist trimmed patterns 132*a*, 132*b*, 132*c*, 132*d* and 132*e*. At this time, the resist trimmed patterns 132*a*, 132*b* of the resist film 31, which form: the ink reservoir 15; the nozzle communicating port 24; and, the through-hole 27*d* for forming the air passage 26, are substantially aligned with each other in cross section of the substrate 30 as viewed in FIG. 13B. On the other hand, resist trimmed patterns 132*c*, 132*e* of the resist film 31 both formed in the front surface of the substrate 30 form: the groove portions 26*a*, 26*b* for forming the air passage 26; and, the through-holes 126*c*, in a manner such that resist trimmed patterns 132*c*, 132*e* have their edges substantially aligned with the corresponding edges of resist trimmed pattern 132*d* of the rear surface of the substrate 30 in cross section of the substrate 30 as viewed in FIG. 13B, or in a manner such that resist trimmed patterns 132*c*, 132*e* have their edges disposed slightly outside a range of the corresponding resist trimmed pattern 132*d*. In each of FIGS. 13B and 13C, though the resist trimmed pattern 132*e* of the resist film 31 is disposed slightly outside the range of the corresponding resist trimmed pattern 132*d*, the resist trimmed pattern 132*c* of the resist film 31 is shown as if it were within the range of the corresponding resist trimmed pattern 132*d* (due to the shortage of the paper in width in the drawings). Incidentally, there is substantially no difference in length or pitch (as viewed in FIG. 13B) between the resist trimmed patterns 132*c* and 132*d* of the resist film 31.

Figure 13B:
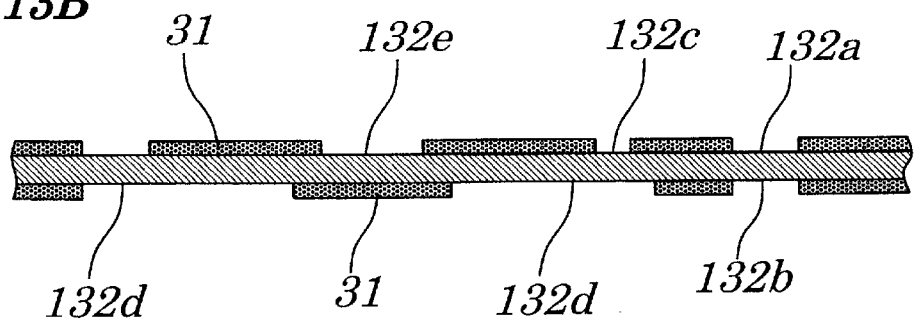
FIG. 13B is a sectional view of the preform of FIG. 13A, after completion of a patterning process thereof.
Figure 14A:
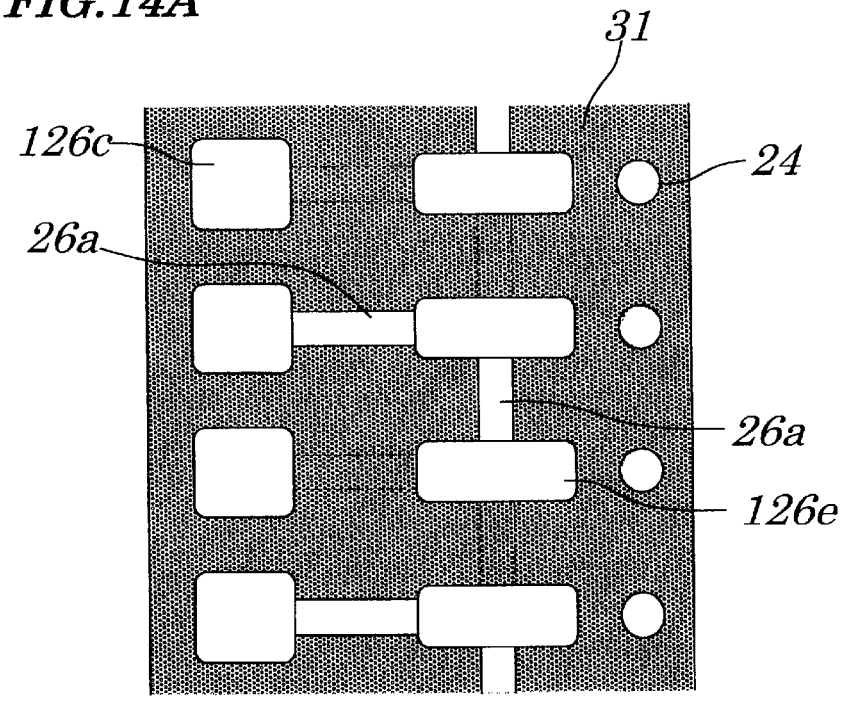
FIG. 14A is a plan view of a front surface of the substrate which forms the reservoir plate's preform in manufacturing the ink jet recording head shown in FIG. 10.
Figure 14B:
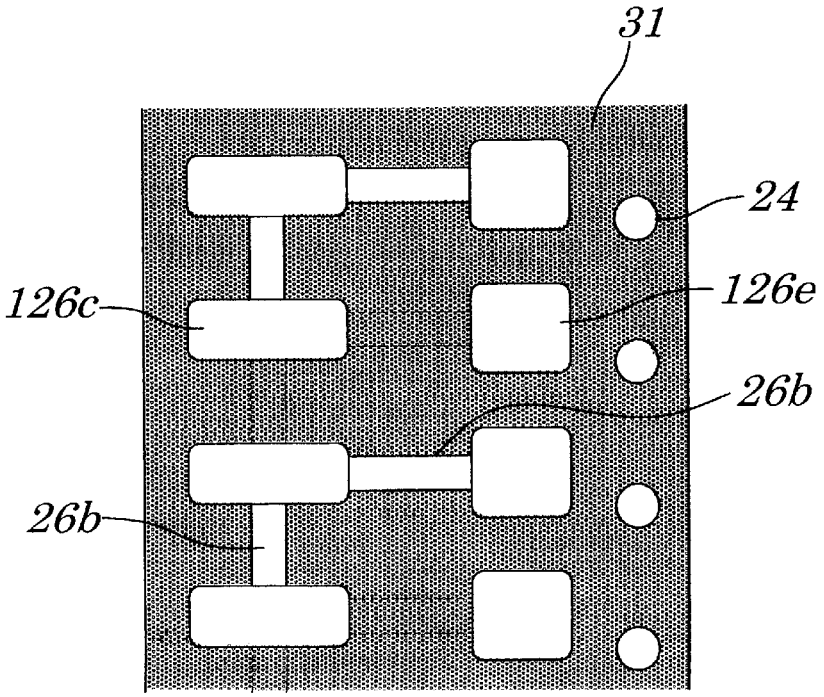
FIG. 14B is a plan view of a rear surface of the substrate shown in FIG. 14A.
Figure 15:
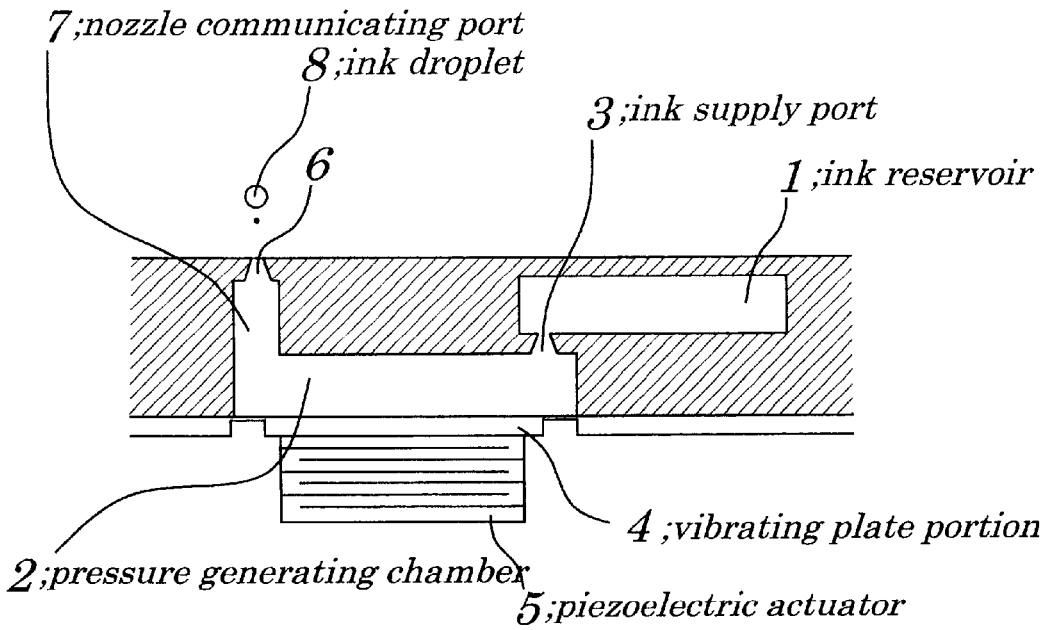
FIG. 15 (PRIOR ART)
FIG. 15 is a sectional view of a conventional ink jet recording head.
Figure 16:
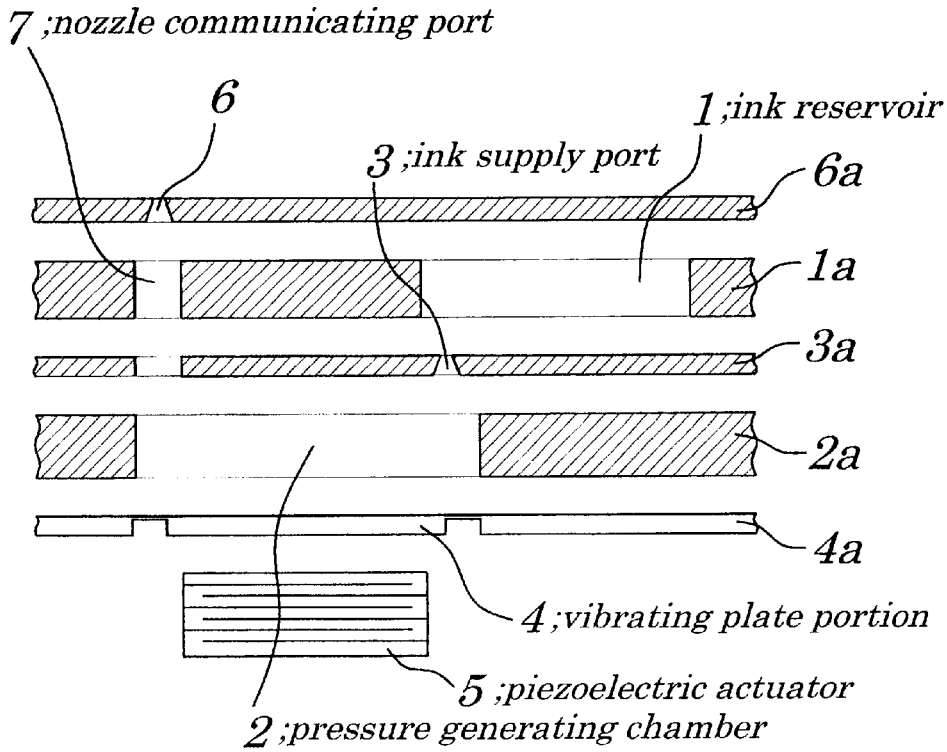
FIG. 16 (PRIOR ART)
FIG. 16 is an exploded sectional view of the conventional ink jet recording head of FIG. 15.

Further, as is clear from FIGS. 13B, 14A and 14B, the resist trimmed patterns 132*c* is displaced from the corresponding resist trimmed patterns 132*d* by a distance equal to half the pitch of the resist trimmed patterns 132*c*, 132*d*.

Figure 12:
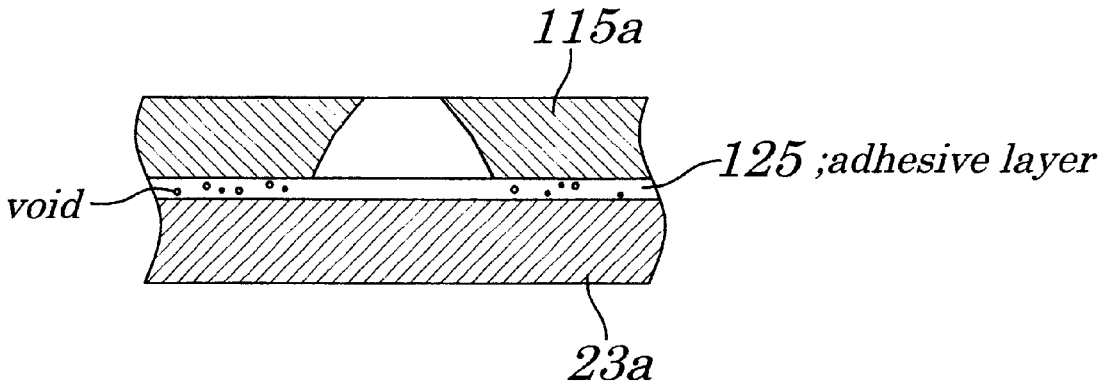
FIG. 12 is a sectional view of a through-hole of the reservoir plate of the third embodiment shown in FIG. 10, taken along a plane perpendicular to both a plane of the reservoir plate and a plane of a paper.

Further, though the through-hole 126*c* assumes a cylindrical shape over its entire length, it assumes a substantially frustoconical shape in cross section as viewed in FIG. 12, taken along a vertical plane perpendicular to both the paper and the opposite surfaces of the reservoir plate 15*a*, since the through-hole 126*c* is inclined relative to the vertical plane. FIG. 13E also shows this inclined through-hole 126*c*.

Figure 13C:
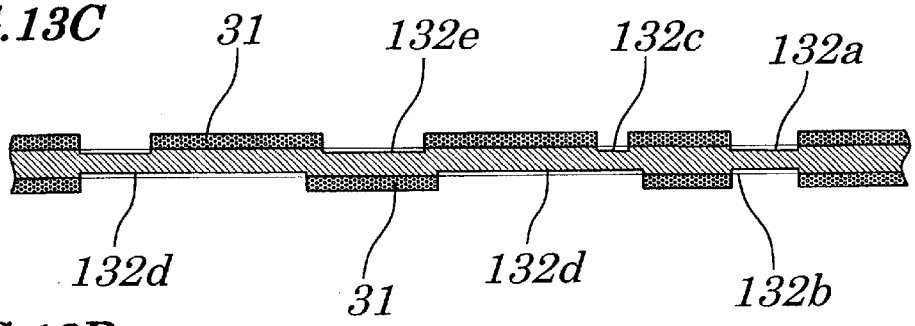
FIG. 13C is a sectional view of the preform of FIG. 13B, after completion of a double-side half etching process thereof.
Figure 13D:
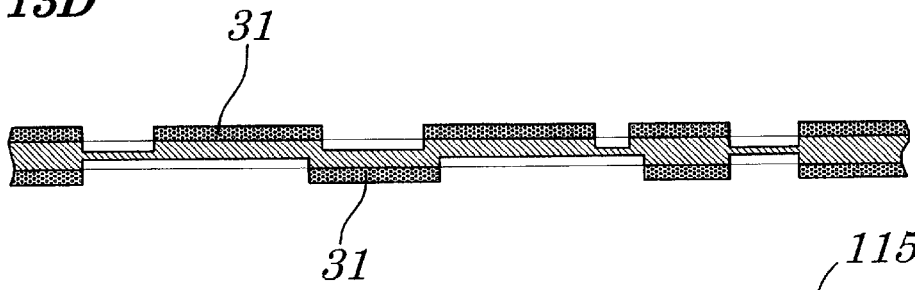
FIG. 13D is a sectional view of the preform of FIG. 13C, after completion of the post baking process of a patterned resist film of the preform.
Figure 13E:
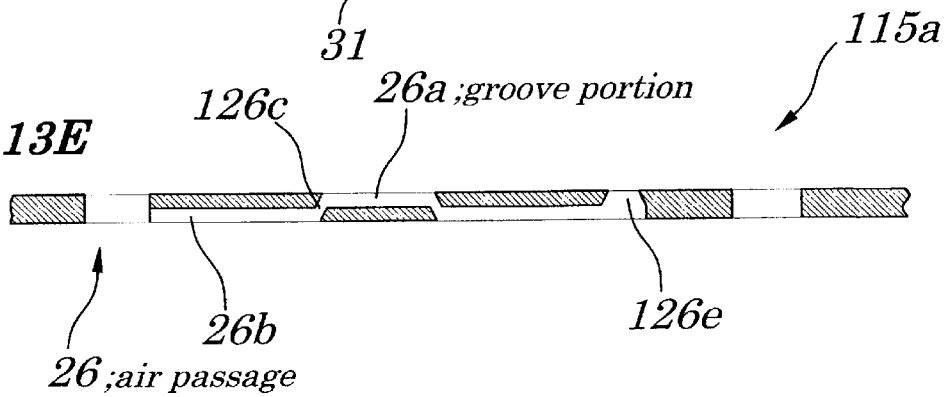
FIG. 13E is a sectional view of the preform of FIG. 13E, after completion of an additional double-side half etching process thereof.

After that, the thus patterned resist film 31 is subjected to a post-baking process, and then successively subjected to a series of the double-side half etching processes, as shown in FIGS. 13C and 13D.

In these double-side half etching processes of the opposite surfaces of the substrate 30, the amount of substantially slightly more than half the thickness of the substrate 30 not covered with the resist film 31 is etched off from one of the opposite surfaces of the substrate 30, and thereby having the groove portions 26*a*, 26*b* forming the air passage 26 staggered along a straight line in the plane of the substrate 3C between the opposite surfaces of the substrate 3C. On the other hand, due to the above construction, as shown in FIG. 13E, the through-holes 126*c*, 126*e* which form each of the ink reservoir 15, the nozzle communicating port 24, and the air passage 26 are formed as a fully etched-off hole in the double-side half etching processes, so that the reservoir plate 15*a* of the third embodiment is completed.

Incidentally, the chamber plate 18*a* is also fabricated in a substantially similar way described above by using the double-side half etching processes of the opposite surfaces of the substrate 30.

Then, the component plates prepared as described are successively stacked Vertically in a stack, and bonded to each other using the adhesive.

In this connection, the adhesive used between the nozzle plate 23*a* and the reservoir plate 115*a* in the above is a thermosetting epoxy-based adhesive which is capable of being cured upon exposure to ultraviolet radiation.

This adhesive is applied to the corresponding connection surfaces of both the nozzle plate 23*a* and the reservoir plate 115*a* by using a suitable printing process such as offset printing processes, letterpress printing processes, screen printing processes, pad-printing processes, transfer printing processes such as stamp transfer printing processes, and like known printing processes. Preferably, the adhesive is applied to only one of the corresponding connection surfaces of the nozzle plate 23*a* and the reservoir plate 115*a*. In this third embodiment, an epoxy-based adhesive layer 125 made of the above adhesive having a thickness of from 2 $\mu$m to 4 $\mu$m is formed only within a range of from 100 $\mu$m to 600 $\mu$m from the edge of each of the cavities (not including the ink ejection nozzles 23) for forming the ink flows passage system (see the adhesive shown in FIG. 1).

In bonding the nozzle plate 23*a* to the reservoir plate 115*a* using the adhesive layer 125, the adhesive layer 125 slightly extruded from the plate connection portion between the nozzle plate 23*a* and the reservoir plate 115*a* when compressed together to form an extruded adhesive portion outside the plate connection portion. After that, only the thus formed extruded adhesive portion is subjected to ultraviolet radiation issued from the side of the reservoir plate 115*a*, and is cured under the influence of such ultraviolet radiation.

After the nozzle plate 23*a* is bonded to the reservoir plate 115*a* under pressure, the supply port plate 19*a* is then bonded to an upper surface of the reservoir plate 115*a* in a substantially similar way described above by using another adhesive layer 125, as is in the first embodiment, wherein: the reservoir plate 115*a* has been already bonded to the nozzle plate 23*a*; and, the another adhesive layer 125 may be made of a thermosetting epoxy-based adhesive capable of being cured upon exposure to ultraviolet radiation.

As described above, in a substantially similar way described above using the adhesive layer 125: the reservoir plate 115*a* is bonded to the upper surface of the nozzle plate 23*a*; the supply port plate 19*a* is bonded to an upper surface of the reservoir plate 115*a*; and, the chamber plate 18*a* is bonded to an upper surface of the supply port plate 19*a*.

In a final bonding process, the vibrating plate 20*a* is bonded to an upper surface of the chamber plate 18*a* by using the adhesive layer 125 in a substantially similar way described above, as is in the first embodiment, whereby the stack of the component plates of the ink jet recording head of the third embodiment is obtained.

Then, the entire stack of the ink jet recording head is compressed in its stacking direction and subjected to a heating process under pressure, so that the adhesive layers 125 sandwiched between adjacent component plates of the ink jet recording head are entirely cured.

As described above, in the method for manufacturing the ink jet recording head of the third embodiment, since the adhesive layer 125 is thin in thickness and applied to only the narrow limited areas, it is possible to considerably reduce the excess amount of the adhesive layer 125 extruded from the plate connection portion. Consequently, in the third embodiment, there is no danger that the presence of the excess amount of the adhesive layer 125 extruded from the plate connection portion causes interference between the ink ejection nozzles in ink ejection operation and increases frictional losses in the ink flow. Due to this, the third embodiment may enjoy the same effect as that obtained in the first embodiment.

Further, in the third embodiment, since the adhesive layer having been extruded from the plate connection portion in a direction opposite to each of the pressure generating chamber 18 and the ink reservoir 15 is substantially free from any ultraviolet radiation, such extruded portion of the adhesive layer 125 may remain uncured to permit the air (voids) trapped in the plate connection portion to easily escape to the atmosphere through the air passage disposed adjacent to this uncured extruded portion of the adhesive layer 125 when the stack of the component plates are compressed in its stacking direction and heated to perform an entire curing operation of the adhesive layer 125 under pressure.

Incidentally, in this curing operation, the adhesive layer 125 having been extruded inside each of the pressure generating chamber 18 and the ink reservoir 15 is completely cured upon exposure to ultraviolet radiation, and therefore functions as a reliable seal for each of the pressure generating chamber 18 and the ink reservoir 15.

Due to this, there is no danger that the pressure generating chamber 18 and the ink reservoir 15 are impaired in airtightness by the presence of the air trapped In the plate connection portion, even when the thickness of the adhesive layer 125 is reduced in the third embodiment.

Further, since the ink jet recording head of the present invention may save the need of individually providing the air passages in each of the front and the rear surface of each of its component plates, there is no danger that any one of the component plates is impaired in mechanical strength. Due to this, the ink jet recording head of the present invention stabilizes its ink ejection characteristics, and is therefore improved in recording quality and in yield in production.

Although the embodiments of the present invention have been described above in detail with reference to the drawings, it should be understood that those skilled in the art could accomplish modifications and changes within the scope of she present invention, and accordingly the present invention should be measured from the following claims.

More specifically, for example, the cavities for forming the pressure generating chamber, the ink reservoir, the ink flow passage system and a like are not limited in location and shape to those shown in the above embodiments. Further, number of the nozzles and number of the pressure generating chambers may vary if necessary.

In the above embodiments, although the epoxy-based adhesive layer is used, other adhesive layers may be used. Suitable adhesive layers include silicone-based adhesive layers, phenolic adhesive layers, urethane-base adhesive layers and a like.

Further, though the thermosetting epoxy-based adhesive which is also capable of being cured upon exposure to ultraviolet radiation is used in the above embodiments, it is also possible to use the other thermosetting adhesives capable of being cured upon exposure to ultraviolet radiation in place of the epoxy-based adhesive.

In the above embodiments, though five pieces of the component plates (which form the ink flow passage system) varying in function and shape are used, the number of these component plates may vary in accordance with application as needs required, provided that the number is any one of odd numbers equal to or more than three. In this case, of a plurality of the odd-numbered component plates, an odd-numbered component plate counted from the side of the nozzle plate 23*a* which is not counted or from the vibrating plate 20*a* which is not counted is provided with the air passages of the present invention.

Further, in the above embodiments, though the air passage is formed in a manner such that it surrounds, on all sides, each of the cavities for forming the ink flow passage system including the pressure generating chambers, the ink reservoirs and the like, it is also possible to form the air passage only in a predetermined part of the peripheral edge portion of each of the cavities.

In the above embodiments, though the adhesive is applied to only an area within a range of from 200 $\mu$m to 300 $\mu$m from the edge of each of the cavities (not including the ink ejection nozzles) for forming the ink flow passage system, the inventors of the present invention have found in their experiments a fact that it is also possible to obtain substantially a same effect as that obtained in the above embodiments even when the adhesive is applied to only an area within a range of approximately 100 $\mu$m from the edge of each of the cavities. Further, even when the adhesive is applied to an area spaced apart from the edge of each of the cavities by a distance of more than approximately 300 $\mu$m, it is possible to obtain substantially the same effect as that obtained in the above embodiments, provided that the area is within a range of approximately 600 $\mu$m from the edge of each of the cavities.

In the above embodiments, for example, while the adhesive is applied to only the area within the range of from 200 $\mu$m, to 300 $\mu$m from the edge of each of the cavities for forming the ink flow passage system in each of the front and the rear surface of the reservoir plate, it is also possible to change the above range of the adhesive applied area in each of the front and the rear surface of the reservoir plate in accordance with a difference in volume between: the adhesive applied to the front surface of the reservoir plate; and, the adhesive applied to the rear surface of the reservoir plate. In the experiments conducted by inventors of the present invention, the above difference in volume of the adhesive is found to be resulted from differences in thickness and surface roughness of the other component plates being bonded to the front and the rear surface of the reservoir plate.

Further, the third embodiment may be combined with the second embodiment.

Finally, the present application claims the Convention Priority based on each of Japanese Patent application Nos.: Hei 11-177434 filed on Jun. 23, 1999; and Hei11-345399 filed on Dec. 3, 1999, the disclosures of which are totally incorporated herein by reference.

What is claimed is:

1. In an ink jet recording head comprising: a nozzle plate provided with nozzles through which ink is ejected; one or more of fluid passage plates which include at least one pressure generating chamber for pressurizing said ink and further include a plurality of cavities for forming an ink flow passage system defined by one or more of said fluid passage plates; a vibrating plate for defining a sealed portion of said pressure generating chamber; a piezoelectric actuator for pressurizing said ink of said pressure generating chamber by displacing said vibrating plate, wherein said piezoelectric actuator is connected with a portion of said vibrating plate corresponding in position to said pressure generating chamber; a plurality of adhesive layers, wherein each of said adhesive layers is inserted between adjacent ones of said fluid passage plates to stack all said plates into a stack which forms said ink jet recording head, improvement wherein:

of said one or more of said fluid passage plates, at least one of said fluid passage plates is provided with an air passage for permitting air trapped in a plate connection portion between any adjacent ones of said plates to escape out of said plate connection portion to the atmosphere when said ink jet recording head is manufactured; and said air passage is constructed of a plurality of groove portions intermittently provided in a vicinity of an edge of at least one of said plurality of cavities for forming said ink flow passage system in each of opposite surfaces of a corresponding one of said plates, wherein said air passage formed in one of said opposite surfaces of said corresponding plate and that formed in the other of opposite surfaces are offset from each other in a plane of said corresponding plate, and communicated with each other through a through-hole to permit said air trapped in said plate connection portion to flow alternately through said air passage of said one of said opposite surfaces of said corresponding plate and that formed in said other of said opposite surfaces, thereby permitting said air trapped in said plate connection portion into escape to the atmosphere.

2. The ink jet recording head according to claim 1, wherein: said air passage provided in the vicinity of said edge of at least one of said plurality of cavities for forming said ink flow passage system in said corresponding plate extends to a side edge portion of said corresponding plate.

3. The ink jet recording head according to claim 1, wherein: said corresponding plate is provided with an atmosphere communicating through-hole; and, said air passage provided in said vicinity of said edge of at least one of said plurality of cavities for forming said ink flow passage system in said corresponding plate extends to an edge portion of said atmosphere communicating through-hole.

4. The ink jet recording head according to claim 1, wherein each of said groove portions which forms said air passages and disposed in said vicinity of said edge of at least one of said plurality of cavities for forming said ink flow passage system is spaced apart from said edge of said cavity by a distance of from equal to or more than 100 $\mu$m to equal to or less than 600 $\mu$m.

5. The ink jet recording head according to claim 1, wherein an adhesive layer is inserted between adjacent ones of said plates in a peripheral portion of each of said plurality of cavities for forming said ink flow passage system.

6. The ink jet recording head according to claim 5, wherein said peripheral portion of said cavity for forming said ink flow passage system is within a range of from equal to or more than 100 $\mu$m to equal to or less than 600 $\mu$m from said edge of said cavity.

7. The ink jet recording head according to claim 5, wherein:

number of said plates for forming said ink flow passage system is an odd number equal to or more than three, wherein said plates for forming said ink flow passage system are provided with said plurality of said cavities which vary in function and shape, and all of said plurality of cavities are combined with each other to form said ink flow passage system; and an odd-numbered one or more of said plates for forming said ink flow passage system as counted from a side of said nozzle plate which is not counted or from a side of said vibrating plate which is not counted are provided with one or more of said air passage.

8. The ink jet recording head according to claim 7, wherein:

a first one of said plates for forming said ink flow passage system as counted from said nozzle plate which is not counted is constructed of a reservoir plate stacked on a corresponding one of said plates for forming said ink flow passage system, wherein said reservoir plate is provided with one of said plurality of cavities, which one forms an ink reservoir for storing said ink therein, said reservoir plate being further provided with an axial part of a nozzle communicating port through which said pressure generating chamber is communicated with said ink ejection nozzle to permit said ink to be supplied to said ink ejection nozzle;

a second one of said plates for forming said ink flow passage system as counted from said nozzle plate which is not counted is constructed of a supply port plate which is provided with an ink supply port and remaining axial part of said nozzle communicating port, wherein through said ink supply port said ink reservoir is communicated with said pressure generating chamber to permit said ink to be supplied to said pressure generating chamber;

a third one of said plates for forming said ink flow passage system as counted from said nozzle plate which is not counted is constructed of a chamber plate provided with one of said plurality of cavities, which one forms said pressure generating chamber;

each of said first and said second one of said plates for forming said ink flow passage system is provided with one or more of said air passages; and said first, said second and said third one of said plates for forming said ink flow passage system are stacked vertically in said stack in this order.

9. The ink jet recording head according to claim 1, wherein said through-hole is formed into a frustoconical shape having a larger one of its opposite end openings directed toward a source of ultraviolet radiation.

10. The ink jet recording head according to claim 9, wherein one of said adhesive layers is sandwiched between: a surface of one of said plates for forming said ink flow passage system, in which surface of said larger one of said opposite end openings of said through-hole is formed; and, a surface of a corresponding one of said plates, which said corresponding one is disposed adjacent to said one of said plates; and said one of said adhesive layers is a thermosetting adhesive layer capable of being cured when subjected to said ultraviolet radiation.

11. The ink jet recording head according to claim 9, wherein:

said through-hole is formed in an area spaced apart from said edge of said cavity for forming said ink flow passage system by a distance within a range of from equal to or more than 100 $\mu$m to equal to or less than 600 $\mu$m; and said thermosetting adhesive layer is applied to an area within a range of from equal to or more than 100 $\mu$m to equal to or less than 600 $\mu$m from said edge of said cavity for forming said ink flow passage system.

12. A method for manufacturing an ink jet recording head comprising:

a nozzle plate provided with at a least one nozzle through which ink is ejected; one or more of fluid passage plates which include at least one pressure generating chamber for pressurizing said ink and further include a plurality of cavities for forming an ink flow passage system defined by one or more of said fluid passage plates; a vibrating plate for defining a sealed portion of said pressure generating chamber; a piezoelectric actuator for pressurizing said ink of said pressure generating chamber by displacing said vibrating plate, wherein said piezoelectric actuator is connected with a portion of said vibrating plate corresponding in position to said pressure generating chamber; a plurality of adhesive layers, wherein each of said adhesive layers is inserted between adjacent ones of said fluid passage plates to stack all said plates into a stack which forms said ink jet recording head, wherein at least one of said one or more of said fluid passage plates is provided with an air passage for permitting air trapped in a plate connection portion between said adjacent ones of said plates to escape out of said plate connection portion to the atmosphere when said ink jet printing head is manufactured, wherein said air passage is constructed of a plurality of groove portions intermittently provided in the vicinity of an edge of at least one of said plurality of cavities for forming said ink flow passage system in each of opposite surfaces of a corresponding one of said plates, wherein said air passage formed in one of said opposite surfaces of said corresponding plate and that formed in the other of opposite surfaces are offset from each other in a plane of said corresponding plate, and communicated with each other through a through-hole to permit said air trapped in said plate connection portion to flow alternately through said air passage of said one of said opposite surfaces of said corresponding plate and that formed in said the other of said opposite surfaces, thereby permitting said air trapped in said plate connection portion to escape to the atmosphere, said method further comprising the steps of:

intermittently providing a plurality of said groove portions in each of opposite surfaces of at least one of said one or more of said flow passage plates so as to be disposed in the vicinity of an edge of at least one of said plurality of cavities for forming said ink flow passage system, wherein said groove portions are staggered in arrangement not to have their front groove portions aligned with their rear groove portions in cross section, wherein said front groove portions are communicated with said rear groove portions through a through-hole to form said air passage; and permitting said air trapped in said plate connection portion to escape from said connection portion when said plates are stacked vertically in a stack which forms said ink jet recording head.

13. The method for manufacturing an ink jet recording head according to claim 12, wherein:

in fabricating at least one of said one or more of said flow passage plates, a plurality of said through-holes are provided in opposite surfaces of said at least one of said flow passage plates in a manner such that said through-holes are disposed in the vicinity of said edge of at least one of said plurality of cavities for forming said ink flow passage system; and said plurality of said groove portions connect adjacent ones of said through-holes with each other, and are arranged not to align with each other in cross section of said at least one of said flow passage plates to form said air passage for permitting said air trapped in said plate connection portion between said adjacent ones of all said plates to escape out of said plate connection portion to the atmosphere when the plates are stacked vertically in said stack.

14. The method for manufacturing an ink jet recording head according to claim 12, wherein:

a plurality of said through-holes are intermittently provided in one of opposite surfaces of at least one of said one or more of said flow passage plates in a manner such that said through-holes are disposed in the vicinity of said edge of at least one of said plurality of cavities for forming said ink flow passage system;

a plurality of said through-holes are intermittently provided also in the other of said opposite surfaces of said at least one of said one or more of said flow passage plates in a manner such that each of said through-holes extends between corresponding rear surfaces of adjacent ones of said groove portions formed in said one of said opposite surfaces, wherein a plurality of said through-holes are formed in portions where said groove portions formed in said one of said opposite surfaces are aligned with those formed in said the other of said opposite surfaces in cross section of said at least one of said flow passage plates, and thereby forming said air passages; and said air passage permit said air trapped in said plate connection portion between said adjacent ones of all said plates to escape out of said plate connection portion to the atmosphere when the plates are stacked vertically in said stack.

15. The method for manufacturing an ink jet recording head according to claim 12, wherein said air passages formed in the vicinity of said edge of said at least one of said plurality of cavities for forming said ink flow passage system in said corresponding plate extends to a side edge portion of said corresponding plate.

16. The method for manufacturing an ink jet recording head according to claim 12, wherein said air passage formed in said vicinity of said edge of said at least one of said plurality of cavities for forming said ink flow passage system in said corresponding plate extends to all edge portion of said atmosphere communicating through-hole.

17. The method for manufacturing an ink jet recording head according to claim 12, wherein each of said groove portions which form said air passage is spaced apart from said edge of each of said plurality of cavities by a distance of more than 100 $\mu$m.

18. The method for manufacturing an ink jet recording head according to claim 12, wherein:

in said step of intermittently providing said groove portions in said opposite surfaces of said at least one of said flow passage plates to form said air passage, opposite surfaces of said corresponding plate are simultaneously subjected to a half etching process so that said plurality of said groove portions are intermittently formed in said opposite surfaces of said corresponding plate in a manner such that said groove portions formed in one of said opposite surfaces are offset from said groove portions formed in the other of said opposite surfaces in cross section of said corresponding plate; and said through-holes are formed in portions where said groove portions formed in said one of said opposite surfaces are aligned with said groove portions formed in said other of said opposite surfaces in cross section of said corresponding plates, and thereby forming said air passages in said corresponding plate.

19. The method for manufacturing an ink jet recording head according to claim 18, wherein said opposite surfaces of said corresponding plate are simultaneously subjected to a half etching process, whereby both said plurality of cavities for forming said ink flow passage system and said air passage are simultaneously formed in said corresponding plate.

20. The method for manufacturing an ink jet recording head according to claim 12, wherein: when adjacent ones of said plates are stacked together in bonding them to each other, said adhesive layer is applied to a peripheral portion of each of said plurality of cavities for forming said ink flow passage system between said adjacent ones of said plates.

21. The method for manufacturing an ink jet recording head according to claim 20, wherein said peripheral portion of each of said plurality of cavities is spaced apart from said edge of each of said plurality of cavities by a distance of equal to or more than 100 $\mu$m, provided that said distance does not exceed a value of 600 $\mu$m at maximum.

22. The method for manufacturing an ink jet recording head according to claim 20, wherein:

number of said plates for forming said ink flow passage system is an odd number equal to or more than three, wherein said plates for forming said ink flow passage system are provided with a plurality of said cavities which vary in function and shape, and all of said plurality of cavities are combined with each other to form said ink flow passage system; and an odd-numbered one or more of said plates for forming said ink flow passage system as counted from a side of said nozzle plate which is not counted or from a side of said vibrating plate which is not counted are provided with one or more of said air passages.

23. The method for manufacturing an ink jet recording head according to claim 22, wherein:

a first one of said plates for forming said ink flow passage system as counted from said nozzle plate which is not counted is constructed of a reservoir plate stacked on a corresponding one of said plates for forming said ink flow passage system, wherein said reservoir plate is provided with one of said plurality of cavities, which one forms an ink reservoir for storing said ink therein, said reservoir plate being further provided with an axial part of a nozzle communicating port through which said pressure generating chamber is communicated with said ink ejection nozzle to permit said ink to be supplied to said ink ejection nozzle;

a second one of said plates for forming said ink flow passage system as counted from said nozzle plate which is not counted is constructed of a supply port plate which is provided with an ink supply port and remaining axial part of said nozzle communicating port, wherein through said ink supply port said ink reservoir is communicated with said pressure generating chamber to permit said ink to be supplied to said pressure generating chamber;

a third one of said plates for forming said ink flow passage system as counted from said nozzle plate which is not counted is constructed of a chamber plate provided with one of said plurality of cavities, which one forms said pressure generating chamber;

each of said first and said second one of said plates for forming said ink flow passage system is provided with one or more of said air passages; and said first, said second and said third one of said plates for forming said ink flow passage system are stacked vertically in said stack in this order.

24. The method for manufacturing an ink jet recording head according to claim 12, wherein said through-hole is formed into a frustoconical shape having a larger one of its opposite end openings directed toward a source of ultraviolet radiation.

25. The method for manufacturing an ink jet recording head according to claim 24, wherein one of said adhesive layers is sandwiched between: a surface of one of said plates for forming said ink flow passage system, in which surface of said larger one of said opposite end openings of said through-hole is formed; and, a surface of a corresponding one of said plates, which said corresponding one is disposed adjacent to said one of said plates; and said one of said adhesive layers is a thermosetting adhesive layer capable of being cured when subjected to said ultraviolet radiation.

26. The method for manufacturing an ink jet recording head according to claim 25, wherein:

said through-hole is formed in an area spaced apart from said edge of said cavity for forming said ink flow passage system by a distance within a range of from equal to or more than 100 $\mu$m to equal to or less than 600 $\mu$m; and said thermosetting adhesive layer is applied to an area within a range of from equal to or more than 100 $\mu$m to equal to or less than 600$\mu$m from said edge of said cavity for forming said ink flow passage system.

* * * * *